United States Patent [19]

Kamp et al.

[11] Patent Number: 4,767,347

[45] Date of Patent: Aug. 30, 1988

[54] ELECTRICAL PANEL ASSEMBLY

[75] Inventors: David C. Kamp; Albert P. Newman, both of Cincinnati, Ohio

[73] Assignee: Cam-Lok Inc., Cincinnati, Ohio

[21] Appl. No.: 67,239

[22] Filed: Jun. 25, 1987

[51] Int. Cl.[4] ..... H01R 13/453

[52] U.S. Cl. ..... 439/133; 439/137

[58] Field of Search ..... 439/133, 136–140, 439/143, 145, 299, 677, 93, 101, 103, 106

[56] References Cited

U.S. PATENT DOCUMENTS 4,113,333 9/1978 Horowitz ..... 439/103

4,542,946 9/1985 Snow ..... 439/137

OTHER PUBLICATIONS

Abbott Brochure–Safety Lock TM Power Distribution System.

*Primary Examiner*—Gil Weidenfeld

*Assistant Examiner*—Paula A. Austin

*Attorney, Agent, or Firm*—Frost & Jacobs

[57] ABSTRACT

An electrical panel assembly providing a plurality of receptacles for use with cable connectors. The connectors and receptacles are of the known type having single contacts which lock together when the connector is mated with the receptacle and rotated a partial revolution with respect thereto. The panel assembly comprises a front panel element with from two to five receptacles arranged in a side-by-side row therebehind. The front panel element has an opening therein for each receptacle through which a cable connector can extend for mating with the receptacle. Polarizing devices are provided in association with each receptacle and each cable connector to assure that each cable connector can be mated only with its respective receptacle. Each panel opening, except the first, is provided with a locking mechansim shiftable between a normal locking position wherein it blocks entrance of a connector into its respective panel element opening and a retracted position permitting entrance of a connector into its respective panel opening. The locking mechanism for each opening is shifted to its retracted position when the appropriate connector is inserted through the preceding opening and mated and locked with its receptacle. Each locking mechanism in retracted position precludes removal of the connector from the preceding opening. As a result of this, the connectors must be connected to their respective receptacles in a given order and disconnected therefrom in the reverse of that order.

18 Claims, 26 Drawing Sheets

ELECTRICAL PANEL ASSEMBLY

TECHNICAL FIELD

The invention relates to an electrical panel assembly having a plurality of receptacles for use with cable connectors, and more particularly to such a panel assembly having polarizing means assuring that each connector is matable only with its respective receptacle, and locking means determining the order in which the connectors are connected and disconnected from their respective receptacles, thereby assuring that ground makes first and breaks last.

BACKGROUND ART

While the invention is by no means intended to be so limited, the panel assembly taught herein is particularly useful in lighting and sound applications for theatrical and concert productions, circuses, television studios, movie studios and the like. It will be appreciated that lighting equipment and sound equipment require a multitude of connections. In these applications, single conductor connectors are preferred. This is true because the cable for multiple conductor connectors is generally of large diameter, very heavy, and difficult to maneuver and transport.

When dealing with single conductor connectors, there are several important factors to consider, to prevent damage to the equipment, and for safety reasons. First of all, it is important that each individual connector be connected only to its intended receptacle. While color coding and various types of indicia are helpful in this respect, they do not preclude error. It is therefore highly desirable that means be provided making it physically impossible to mate a connector with any receptacle other than its intended receptacle. Secondly, it is frequently important, both to protect the equipment and as a safety factor, to connect and disconnect a series of connectors to and from a panel in a particular order. For example, where a ground is used, it is generally desirable that the ground makes first and breaks last.

The teachings of the present invention provide a panel assembly wherein means are provided to prevent mating of a contact with other than its intended receptacle. The system further provides means requiring the connectors to be mated with their respective receptacles in a given order, and disconnected therefrom in the reverse of that order. The panel of the present invention can serve either as an input panel or as an output panel and can be used in electrical systems requiring three, four, or five receptacles.

DISCLOSURE OF THE INVENTION

According to the invention there is provided an electrical panel assembly having a plurality of receptacles for use with single contact cable connectors. The connectors and receptacles are of the well known type having single contacts which lock together when the connector is mated with the receptacle and rotated a partial revolution with respect thereto.

The panel assembly comprises a front panel element with from two to five receptacles mounted therebehind in a side-by-side row. In an exemplary embodiment, the panel may have a ground receptacle, a neutral receptacle, and first, second and third current carrying receptacles, arranged in that order. The front panel element has an opening therein for each receptacle through which a cable connector can be extended for mating with the receptacle. Polarizing devices are provided in association with each receptacle, and in association with each cable connector, to assure that each cable connector can be mated only with its respective receptacle. Each front panel element opening, except for the first opening for the ground receptacle, is provided with a locking mechanism shiftable between a normal locking position wherein it blocks entrance of a connector into its respective front panel element opening and a retracted position permitting entrance of a connector into its respective front panel element opening. The locking mechanism for each front panel element opening is shifted to its retracted position when the appropriate connector is inserted through the preceding front panel element opening and mated and locked with its receptacle. Each locking mechanism in retracted position precludes removal of the connector from the preceding front panel element opening. As a result, the ground, neutral, and first, second and third connectors must be connected to the panel assembly in that order, and can only be disconnected therefrom in the reverse order.

In a first embodiment of the present invention, each connector is provided with a surrounding polarizing shell, which partially enters the front panel element opening when the connector is mated with its respective receptacle. The panel assembly comprises the front panel element, an intermediate panel element and a rear panel element joined together in parallel spaced relationship. The rear panel element supports the receptacles. The intermediate panel element has openings formed therein coaxial with the front panel element openings and the receptacles. Each opening in the intermediate panel element has a unique peripheral shape. The polarizing shell of each connector has a forward portion having a peripheral shape matching only the appropriate one of the openings in the intermediate panel element. This assures mating of a connector only with its respective receptacle.

Each locking mechanism comprises an L-shaped lock-out lever which, in its normal position, blocks its respective opening in the front panel element. A latch locks the lock-out lever in its normal position. When the appropriate connector is inserted in the preceding front panel element opening and is mated and locked with its respective receptacle, the latch for the adjacent lock-out lever is shifted to a releasing position and the lock-out lever is shifted to its retracted position permitting the next connector to be mated and locked with its respective receptacle. When a given connector is mated and locked with its receptacle, the preceding connector cannot be disconnected from its respective receptacle. This mechanism assures that the connectors are connected with their respective receptacles in a given order and can be disconnected therefrom only in the reverse of that order.

In a second embodiment of the present invention, the front panel element has a receptacle housing mounted to the rear surface thereof behind each of the front panel element openings. Each front panel element opening is provided with a cover, biased to the closed position. Each receptacle housing is provided with a locking pin which normally engages and locks the cover of the next succeeding front panel element opening in closed position. The receptacle housing contains a latch which normally locks the locking pin in its locking position. Each connector is provided with a polarizing shell and each housing is provided with a mating polarizing ring so that each connector can be connected only with its intended receptacle. When the first or ground connector is connected and locked to its respective receptacle, its polarizing ring shifts the latch to an inactive position releasing the locking pin so that the next front panel element cover can now be opened and its respective connector can now be mated with its appropriate receptacle. When each front panel element cover is released and opened in this way, it maintains its respective locking pin in its unlocking position. This, in turn, prevents removal of the preceding connector from the panel assembly. Thus, as in the first embodiment, the connectors must be connected to their respective receptacles in the second embodiment in a given order and can be disconnected only in the reverse of that order.

DETAILED DESCRIPTION OF THE INVENTION

Figure 1:
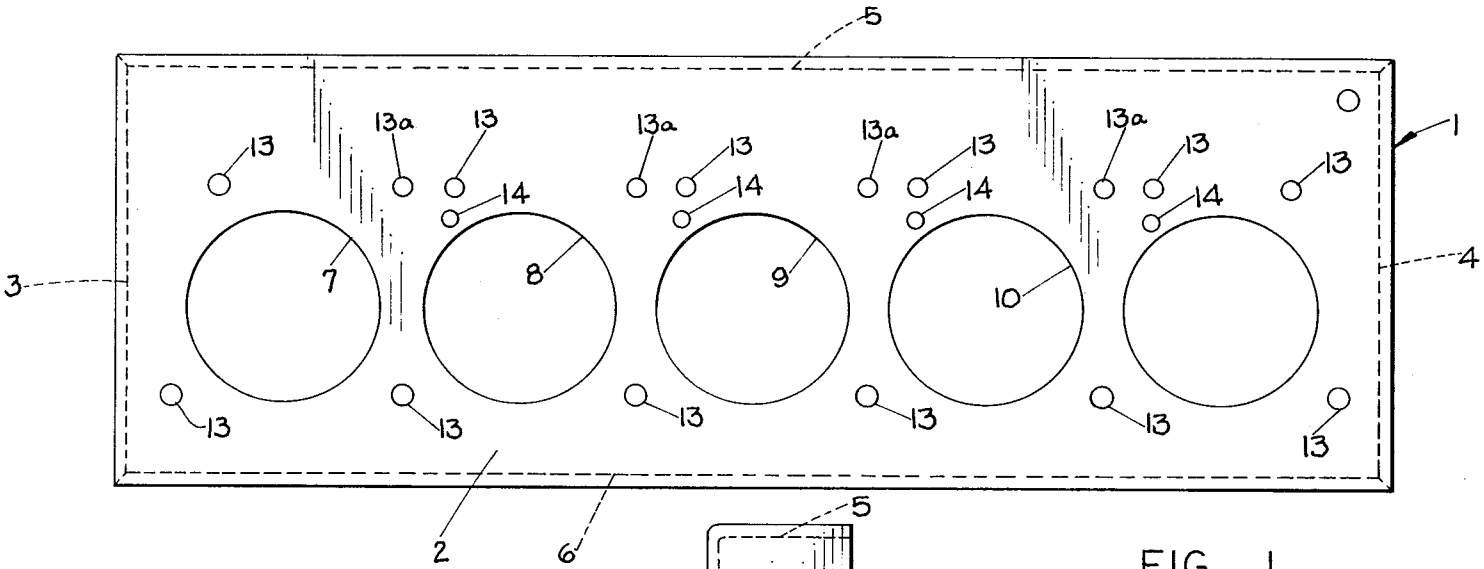
FIG. 1 is an elevational view of the front panel element of the panel assembly of the present invention.
Figure 2:
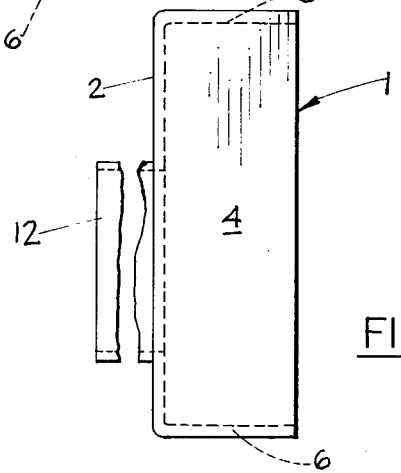
FIG. 2 is an end elevational view of the front panel element of FIG. 1, as seen from the right of FIG. 1.

A first embodiment of the present invention is illustrated in FIGS. 1 through 22. For purposes of clarity, in all of the figures, like parts have been given like index numerals.

The first embodiment of the panel assembly of the present invention is made up of three panel elements: a front panel element, an intermediate panel element, and a rear panel element. The front panel element is generally indicated at 1 in FIGS. 1 and 2. Front panel element 1 comprises a planar panel portion 2 provided with rearwardly extending, integral side walls 3 and 4, a top wall 5 and a bottom wall 6.

Panel portion 2 is provided with five identical circular openings 7 through 11, adapted to receive the connectors for a ground cable, a neutral cable, and first, second and third line or current carrying cables, respectively. The panel portion 2 may carry appropriate indicia and color coding (if desired) to indicate this sequence of cables. Similarly, the cable connectors may be correspondingly color coded. Each of the openings 7 through 11 is surrounded by a cylindrical, forwardly extending shroud 12, rendering the panel more tamperproof. The shrouds 12 may be welded or otherwise appropriately affixed to the face of panel portion 2.

Panel portion 2 is provided with a plurality of holes 13 for the receipt of bolts by which the panel assembly is joined together, as will be apparent hereinafter. Four additional, similar holes 13*a* are provided, which also receive assembly bolts on which the lock-out levers, to be described hereinafter, are mounted. Finally, panel portion 2 is provided with four perforations 14 in which pan head stop-screws are mounted, as will be explained hereinafter.

Figure 3:
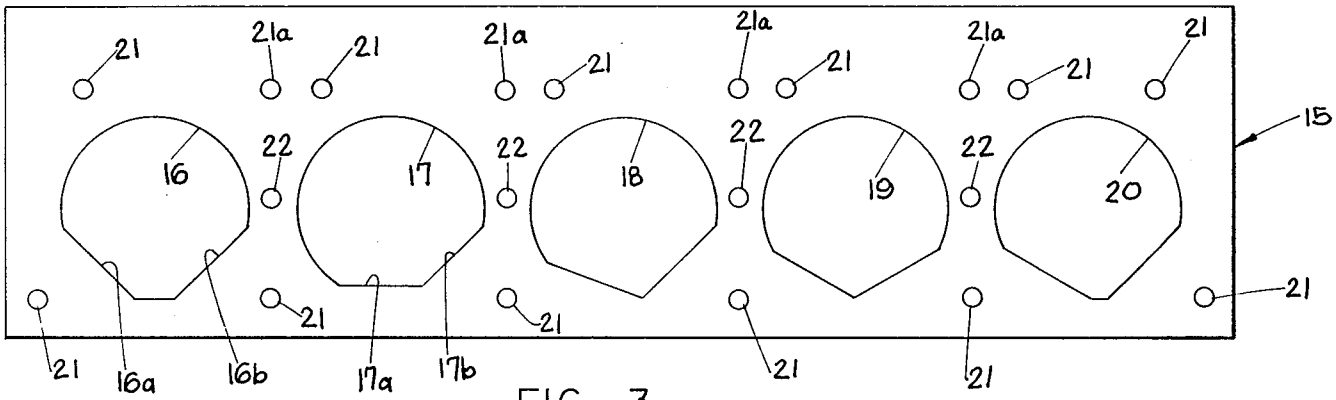
FIG. 3 is an elevational view of the intermediate panel of the panel assembly of the present invention.

The intermediate or polarizing panel element of the panel assembly is generally indicated at 15 in FIG. 3. The intermediate polarizing panel element 15 is a planar element of such dimensions as to be receivable within the confines of the side walls 3 and 4, the top wall 5 and the bottom wall 6 of front panel element 1. Intermediate polarizing panel element 15 has a series of openings 16 through 20 formed therein. When the intermediate polarizing panel element 15 is assembled with front panel element 1, the openings 16 through 20 are coaxial with the openings 7 through 11, respectively, and are of the same diameter. It will be noted, however, that the openings 16 through 20 are each provided with a pair of flats, so arranged that each of the openings 16 through 20 has a unique peripheral shape. The openings 16 through 20 serve a polarizing function, each opening only permitting the passage therethrough of the forward end of a connector which has a matching peripheral shape. As a consequence, intermediate polarizing panel element 15 assures that each cable connector will be inserted in the panel assembly only at its proper position.

The intermediate polarizing panel element 15 is provided with a plurality of holes 21 corresponding to holes 13 of front panel element 1, and serving the same purpose. Intermediate polarizing panel element 15 is also provided with four holes 21*a*, corresponding to front panel element holes 13*a*, and four additional holes 22 through which the nose portion of the latch plunger can extend, as will be apparent hereinafter.

Figure 4:
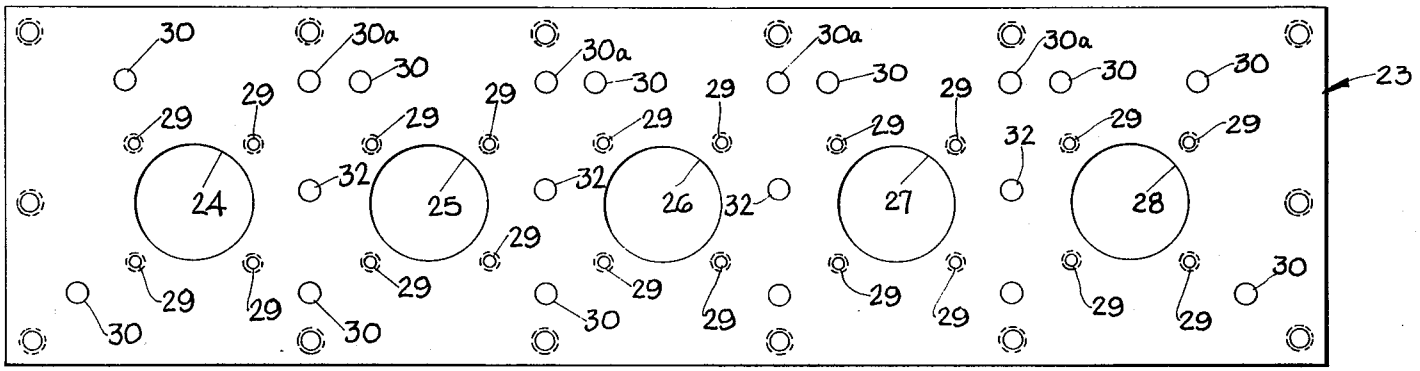
FIG. 4 is an elevational view the rear panel of the panel assembly of the present invention.

The rear panel element is generally indicated at 23 in FIG. 4. This panel element is also a planar member of such dimensions as to be receivable within the confines of side walls 3 and 4, top wall 5, and bottom wall 6 of front panel element 1. The rear panel element 23 is provided with a series of circular openings 24 through 28. The openings 24 through 28 correspond to and are coaxial with the openings 16 through 20, respectively, of intermediate polarizing panel element 15 and openings 7 through 11, respectively, of front panel element 1. The openings 24 through 28 accommodate the forward ends of receptacles, as will be apparent hereinafter. Each of the openings 24 through 28 are surrounded by four holes 29 to receive bolts mounting the receptacles, again as will be apparent hereinafter. Rear panel element 23 is provided with holes 30 corresponding to holes 21 of intermediate polarizing panel element 15 and holes 13 of front panel element 4, together with holes 30*a* which similarly correspond to holes 21*a* and 13*a* of intermediate panel element 15 and front panel element 1, respectively. Finally, rear panel element 23 is provided with four holes 32, corresponding to holes 22 of intermediate panel element 15, and adapted to receive screws for mounting the latch housings, as will be described hereinafter.

Figure 6:
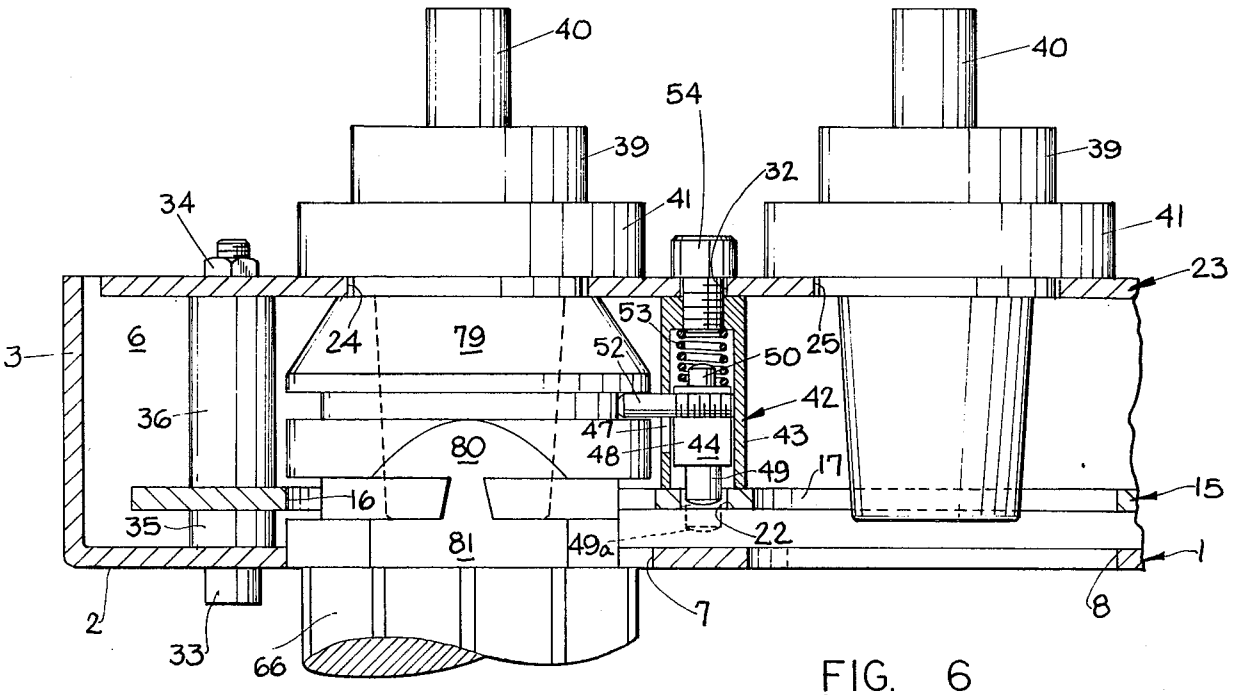
FIG. 6 is a fragmentary cross sectional plan view taken along section line 6—6 of FIG. 5, with the lock-out levers removed.
Figure 7:
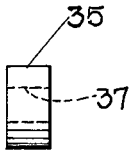
FIGS. 7 and 8 are elevational views of short and long spacers, respectively, used in the panel assembly of FIGS. 5 and 6.
Figure 8:
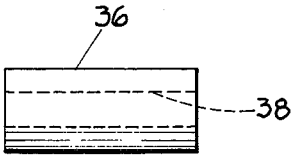

Reference is now made to FIG. 6, wherein the panel elements 1, 15 and 23 are shown in assembled relationship. The panel elements 1, 15 and 23 are fixed in parallel spaced relationship by a plurality of bolts, one of which is shown at 33. It will be understood that the bolt 33 passes through a corresponding set of perforations 13, 21 and 30 in panel elements 1, 15 and 23, respectively. The bolt 33 is provided with a nut 34. The bolt 33 carries a short spacer 35 between panel elements 1 and 15 and a long spacer 36 between panel elements 15 and 23. The short spacer 35 is illustrated in FIG. 7 and comprises a cylindrical member having a central bore 37 through which the bolt 33 extends. The longer spacer 36 is illustrated in FIG. 8 and comprises a cylindrical element of the same diameter as spacer 35 and having an axial bore 38 through which bolt 33 extends. It will be understood by one skilled in the art that there will be a similar bolt and spacer assembly passing through each set of corresponding perforations 13-21-30 and 13*a*-21*a*-30*a* in panel elements 1, 15 and 23, respectively.

A receptacle is mounted to the rear surface of rear panel element 23 at the position of each of the perforations 24 through 28 therein. The receptacles are identical and two such receptacles are shown in FIG. 6 at 39.

Figure 18:
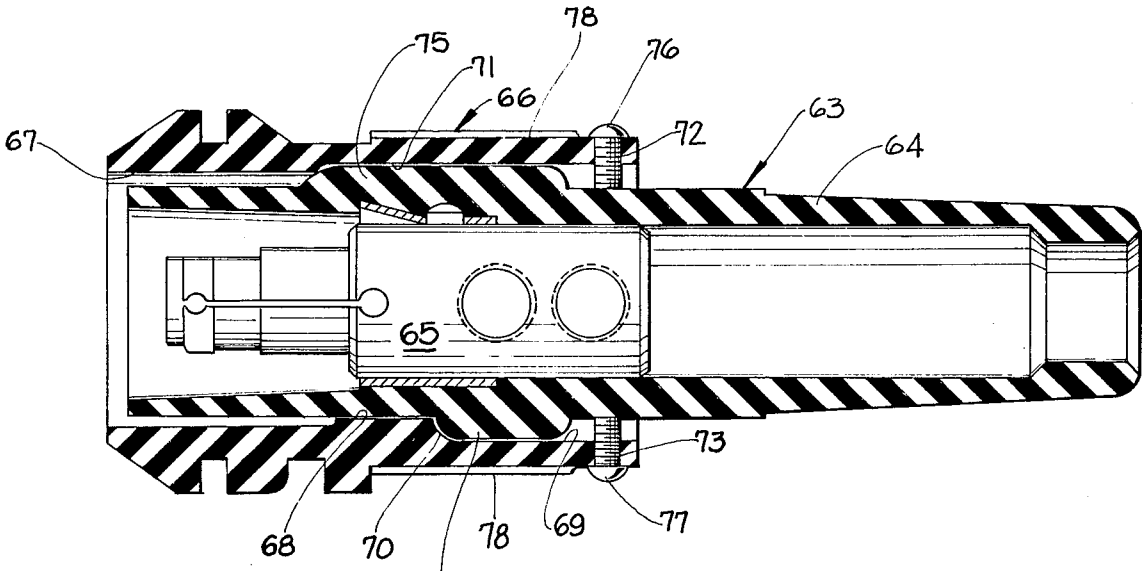
FIG. 18 is a cross sectional view illustrating the polarizing shell of FIGS. 13–16 affixed to a male connector.

Each receptacle comprises an insulative housing surrunding a contact. The rearward end of the contact is shown at 40 and is attached to a cable, bus bar or the like, as is well known in the art. For purposes of an exemplary showing, the receptacles 39 should be considered to be female receptacles, having female contacts 40 adapted to cooperate with the male contacts of the male connectors, one of which is shown in FIG. 18. It will be understood that the receptacles could be male receptacles adapted to cooperate with female connectors.

As is apparent from FIG. 6, the forward portion of the insulative housing of the receptacles 39 extend through their respective one of the openings 24 through 28 in rear panel element 23 and just beyond their respective one of the openings 16 through 20 of intermediate panel element 15. Each insulative housing of each receptacle 39 has a rectangular flange portion 41 provided with four perforations (not shown) corresponding to the set of four perforations 29 adjacent each of the openings 24 through 28 in rear panel element 23. Bolts (not shown) pass through the receptacle flange perforations and the perforations 29 of rear panel element 23, thereby firmly mounting the receptacles to the rear panel element 23.

Figure 10:
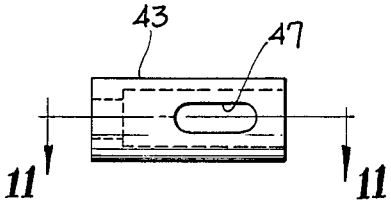
FIG. 10 is an elevational view of the latch housing.
Figure 11:
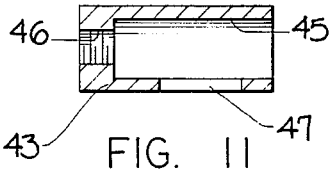
FIG. 11 is a cross sectional view taken along section line 11—11 of FIG. 10.
Figure 13:
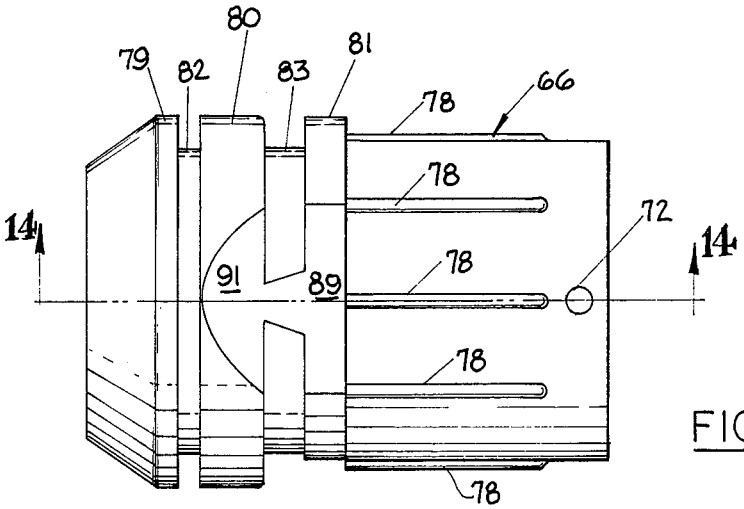
FIG. 13 is a plan view of a polarizing shell.

In FIG. 6, a latch mechanism is generally indicated at 42. Latch mechanism 42 comprises a latch housing 43 and a latch plunger 44. The latch housing is illustrated in FIGS. 10 and 11. Latch housing 43 comprises a cylindrical member having the same external dimensions as the long spacer 36 of FIG. 8. As is most clearly shown in FIG. 11, the latch housing 43 has a large diameter axial bore 45 which terminates near the rearward end of the latch housing in a smaller diameter bore 46. The bore 46 is internally threaded. Finally, the cylindrical wall of latch housing 43 has an elongated longitudinal slot 47 formed therein, as is clearly shown in FIG. 10.

Figure 12:
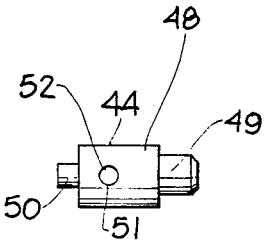
FIG. 12 is an elevational view of the latch plunger of the present invention.

The latch plunger 44 is illustrated in FIG. 12. The latch plunger 44 has a main body portion 48 of such diameter as to be slidable within the large axial bore 45 of latch housing 43. At its forward end, the latch plunger 44 has a nose portion 49 which is cylindrical and of such diameter as to be slidable within any one of the perforations 22 of intermediate polarizing panel element 15 (see FIG. 3). At its rearward end, the latch plunger 44 has a yet smaller diameter cylindrical portion 50 which serves as a spring seat. The main body portion 48 of latch plunger 44 is provided with a transverse threaded perforation 51 in which a laterally extending pin 52 is threadedly engaged (see FIG. 6).

Turning to FIG. 6, it will be noted that the plunger 44 is located within latch housing 43, together with a compression spring 53. The latch housing is affixed to the rear panel element by means of a machine screw 54 which extends through one of the perforations 32 in the rear panel element 23 and is threadedly engaged in the axial bore 46 of latch housing 43. The compression spring extends between the shoulder formed between axial bores 45 and 46 in the latch housing and the rearward end of the main body portion 48 of latch plunger 44, receiving the spring seat element 50. The latch pin 52 is threadedly engaged in the transverse perforation 51 of the main body portion 48 of latch plunger 44 and extends through the elongated slot 47 of latch housing 43.

It will be noted from FIG. 6 that the nose portion 49 of latch plunger 44 is aligned with a perforation 22 in the intermediate polarizing panel element 15. The latch plunger 44 is illustrated in FIG. 6 in its retracted position wherein the latch plunger nose 49 does not extend beyond the forward face of intermediate polarizing panel element 15. In its normal position, to which it is biased by compression spring 53, the latch plunger occupies a position wherein the forward end of nose portion 49 extends forwardly of the front face of intermediate polarizing panel element 15, as is shown in broken lines at 49*a*.

It will be apparent to one skilled in the art that there will be a latch assembly 42 so mounted on rear panel element 23 at the position of each of the four holes 32 formed therein. When the plungers of the four latch assemblies are in their normal positions, they will extend through each of the four holes 22 in the intermediate polarizing panel element 15. Each latch assembly 42 cooperates with a lock-out lever, next to be described.

Figure 9:
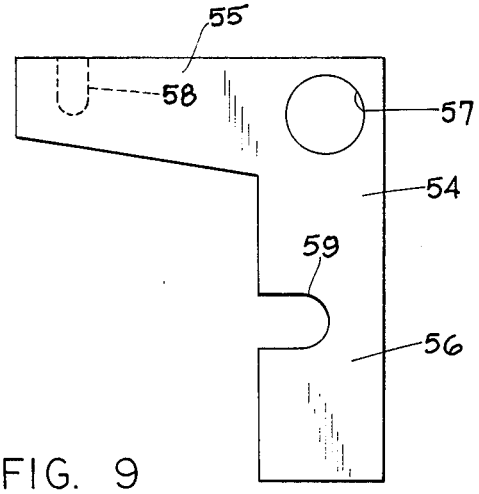
FIG. 9 is an elevational view of the lock-out lever of the present invention.

Reference is made to FIG. 9 wherein a lock-out lever is shown at 54. It will be noted that the lock-out lever 54 is L-shaped, having a first leg 55 and a second leg 56. At the juncture of lock-out lever legs 55 and 56, there is a perforation 57 so sized as to receive a short spacer 35 therein with sufficient clearance that the lock-out lever is pivotally mounted thereon. The leg 55, near its free end, has a bore 58 formed therein from its upper edge. The purpose of bore 58 will be apparent hereinafter. The other leg 56 of lock-out lever 54 has a clearance notch 59 formed therein. Again, the purpose of clearance notch 59 will be set forth hereinafter.

Figure 5:
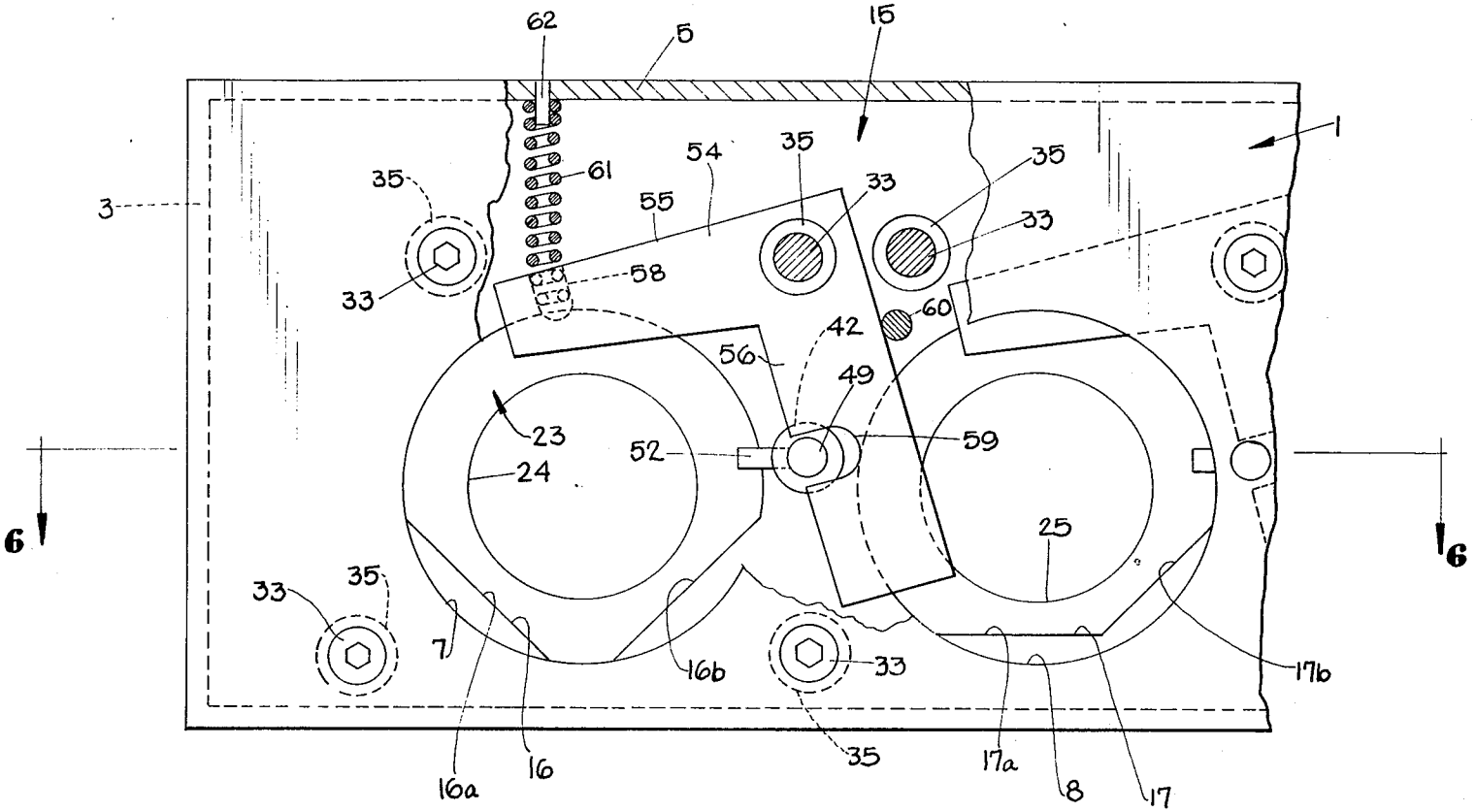
FIG. 5 is a fragmentary elevational view, partly in cross section, illustrating the assembled panel elements of the present invention.

Reference is now made to FIG. 5 which is an elevational view of the assembly of FIG. 6. In FIG. 5, a portion of the front panel element 1 has been broken away. For purposes of clarity, the receptacles 39 of FIG. 6 have been omitted from FIG. 5.

It will be apparent from FIG. 5 that the lock-out lever 54 is pivotally mounted between front panel element 1 and intermediate polarizing panel element 15 on the short spacer 35 of a bolt 33 which passes through that set of aligned perforations 13*a*, 21*a*, and 30*a* of panel elements 1, 15, and 23, respectively, the aligned perforations being located between openings 7 and 8 in front panel element 1. It will be understood that there will be four such lock-out levers 54 similarly mounted at each position of aligned perforations 13*a*, 21*a* and 30*a* of panel elements 1, 15 and 23, respectively. Thus, there will be a lock-out lever 54 located between openings 7 and 8, openings 8 and 9, openings 9 and 10, and openings 10 and 11 in front panel element 1.

In FIG. 5, the lock-out lever 54 is shown in its normal position. Its normal position is determined by abutment of the lock-out lever leg 56 against a stop element 60. The stop element 60 constitutes a pan head screw threadedly engaged in a perforation 14 in front panel element 1 (see FIG. 1). There will be such a stop screw in each of the perforations 14. The lock-out lever 54 is urged to the normal position shown in FIG. 5 by a compression spring 61. The compression spring 61 is mounted at one end in the bore 58 in lock-out lever leg 55. At the other end, compression spring 61 engages a pin 62, serving as a spring seat, and mounted in the top wall 5 of panel element 1. It will be noted in FIG. 5 that the notch 59 in lock-out lever leg 56 provides clearance for the nose portion 49 of the plunger of latch assembly 42. The reason for this will be apparent hereinafter.

Reference is now made to FIG. 18 wherein an exemplary, conventional connector is generally indicated at 63. The connector 63 comprises an insulative housing 64 surrounding a contact 65. For purposes of an exemplary showing, the contact 65 is illustrated as being a male contact, adapted to cooperate with a female contact in the appropriate one of the receptacles 39. As indicated above, the contact in connector 63 could be a female contact, and the contact 40 in receptacle 39 could be a male contact, and the functioning of the panel assembly of the present invention would be the same in either case. The male and female contacts are of the general type taught in U.S. Pat. No. Re. 25,506, wherein the male contact is provided with an L-shaped peripheral channel and the female contact is provided in its socket with an inwardly projecting pin, the channel and pin cooperating to lock the contacts together when the male contact is inserted in the female contact and then rotated approximately 90°. Such locking of the male and female contacts upon engagement and rotation is well known in the art.

The connector 63 has a polarizing shell, generally indicated at 66, mounted on the exterior of its insulative housing 64. The polarizing shell 66 serves two functions. First of all, the polarizing shell 66 is so shaped that it and the forward portion of connector 63 can pass through only the similarly shaped opening in the intermediate polarizing panel element 15. Secondly, the polarizing shell 66 operates the lock-out lever 54 and latch assembly 42 in such a way that a connector can be inserted in opening 8 of FIG. 5 only after a connector has been inserted and locked in opening 7, and in such a way that the connector located in opening 7 in FIG. 5 can be removed therefrom only after the connector located in opening 8 has been removed. The manner in which this is accomplished will be explained.

The polarizing shell 66 of FIG. 18 is further illustrated in FIGS. 13 through 16 and is so configured as to cooperate with the opening 16 of intermediate polarizing panel element 15.

The polarizing shell 66 comprises a generally cylindrical member having an axial bore. The axial bore has a first portion 67 near the forward end of the polarizing shell and an intermediate portion 68 of lesser diameter than the portion 67. Near its rearward end, the axial bore has a portion 69 of greater diameter than either of the portions 67 or 68. The juncture of bore portions 68 and 69 define a shoulder 70. The bore portion 68 is relieved near its top, as at 71. Near its rearward edge, the polarizing shell has a pair of diametrically opposed perforations 72 and 73.

Returning to FIG. 18, the connector 63 can be inserted in the polarizing shell from the rearward end of the polarizing shell. The insulative housing 64 of connector 63 has an annular portion 74 of enlarged diameter. At its upper end, the annular enlarged diameter portion 74 has a forward extension 75. The forward extension 75 is accommodated by the polarizing shell relief 71 and the forward end of the annular enlarged diameter portion 74 of connector housing 64 abuts the annular shoulder 70 of polarizing shell 66. This precludes the connector 63 from further forward travel within polarizing shell 66. Rearward movement of the connector with respect to the polarizing shell is precluded by self-tapping screws 76 and 77 threadedly engaged in polarizing shell perforations 72 and 73 and contacting the insulative housing 64 of connector 63. The forward extension 75 of the larger diameter portion 74 of the connector housing 64 cooperates with the polarizing shell relief 71 to preclude rotation of the connector 63 relative to polarizing shell 66.

The rearward portion of polarizing shell 66 has a substantially cylindrical exterior provided with longitudinal ribs 78 so that it may be more easily grasped for manual rotation of the polarizing shell connector assembly. The forward portion of polarizing shell 66 comprises first, second and third ribs 79, 80 and 81 of equal diameter greater than the diameter of rearward rib bearing portion of the shell, and defining therebetween a pair of grooves 82 and 83.

The first rib 79 has a front portion which is tapered inwardly and forwardly to assist in insertion of the polarizing shell and its connector into the opening 7 of front panel element 1 and the opening 16 of intermediate polarizing panel element 15. The first rib 79 is also provided with a pair of flats 84 and 85 matching the flats **16*a* and 16*b*, respectively, of the polarizing opening 16 of the intermediate polarizing panel element 15 (see also FIGS. 3 and 5). In addition, the first annular rib 79 has a notch 86 providing clearance for the pin 52 of the latch assembly 42. The remainder of the periphery of the first rib 79 is circular, as is most clearly seen in FIG. 16**.

The second rib 80 has an annular peripheral surface except for a pair of flats 87 and 88 which correspond to the first rib flats 84 and 85, respectively, as well as the flats **16*a* and 16*b* of the opening 16 of intermediate polarizing panel element 15. The third rib 81 also has an annular peripheral surface except for a pair of flats 89 and 90. The flat 89 is located at the top of rib 81 (as viewed in FIG. 16) and the flat 90 is located to the right thereof. It will be noted that the flats 89 and 90 are perpendicular with respect to each other. The polarizing shell 66 is completed by the provision of a relief 91 (see FIG. 13) which extends from the flat 89 on third rib 81 through the groove 83 and into the second rib 80, sloping forwardly and outwardly. The relief 91 assists in the removal of polarizing shell 66 and its connector 63 from the panel assembly, and from beneath the leg 55 of lock-out lever 54**, as will be apparent hereinafter.

Figure 17:
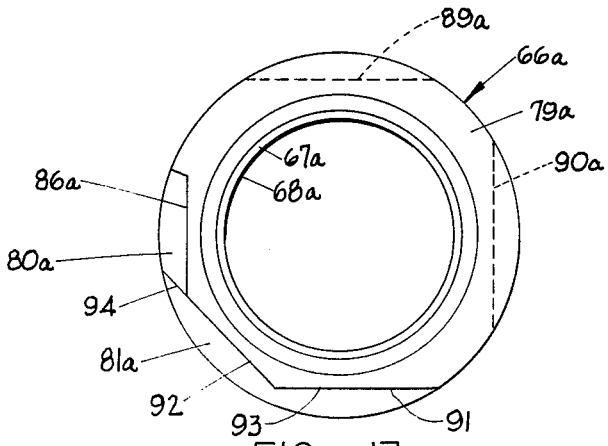
FIG. 17 is a front elevational view of another similar polarizing shell.

FIG. 17 is a front elevational view of a second polarizing sleeve **66*a* adapted to cooperate with the opening 8 in the front panel element 1 and the polarizing opening 17 of the intermediate polarizing panel element 15. Those parts of the polarizing shell 66*a* which are identical to corresponding parts of polarizing shell 66 are given the same index numerals followed by "a". It will be immediately apparent that the polarizing shell 66*a* is identical to the polarizing shell 66 with the exception that the forward rib 79*a* is provided with flats 91 and 92 and the second or intermediate rib 80*a* is provided with similar flats 93 and 94, adapted to cooperate with the flats 17*a* and 17*b*, respectively, of opening 17 in the intermediate polarizing panel element 15**.

Figure 16:
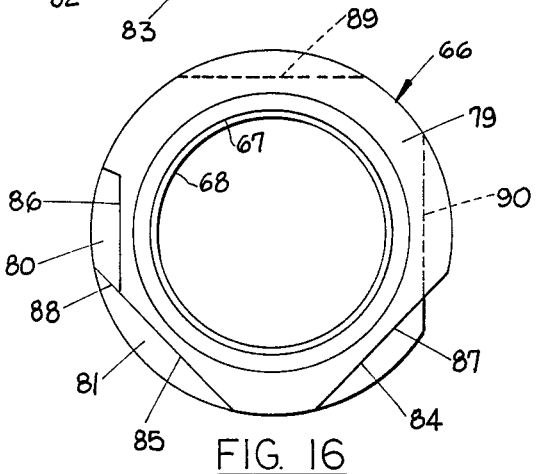
FIG. 16 is a front end elevational view of the polarizing shell of FIGS. 13–15.

The polarizing shell 66 of FIG. 16 is intended for use with the ground cable connector. The polarizing shell **66*a* of FIG. 17 is intended for use with the neutral connector. It will be understood that the polarizing shells (not shown) for use with the first, second, and third line cables, will be identical to the shells 66 and 66*a* of FIGS. 16 and 17 with the exception that, in each instance, the shells will be given flats corresponding to flats 18*a* and 18*b* of intermediate panel element opening 18, flats 19*a* and 19*b* of intermediate panel element opening 19, and flats 20*a* and 20*b* of intermediate panel element opening 20**, respectively.

The first embodiment of the present invention having been described in detail, its mode of operation can now be set forth.

Reference is first made to FIG. 5 wherein the front panel openings 7 and 8 for the ground and neutral cable connectors, respectively, are shown. The lock-out lever 54 between openings 7 and 8 is shown in its normal position, determined by stop screw 60. The lock-out lever 54 is maintained in this normal position under the urging of compression spring 61. The nose portion 49 of latch assembly 42 is in its extended position as shown in broken lines at 49*a* in FIG. 6, and is accommodated by the clearance notch 59 in the leg 56 of lock-out lever 54. It will be understood that the remaining lock-out levers between front panel element openings 8 and 9, 9 and 10, and 10 and 11, will occupy the same position as shown with respect to lock-out lever 54 in FIG. 5. The same is true of the nose of the latch plunger of each of the latch assemblies located between front panel element openings 8 and 9, 9 and 10, and 10 and 11.

Figure 14:
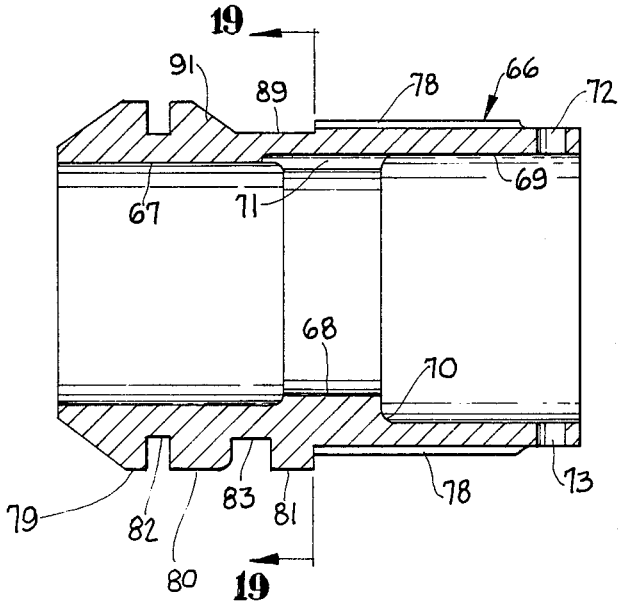
FIG. 14 is a cross sectional view taken along section line 14—14 of FIG. 13.
Figure 15:
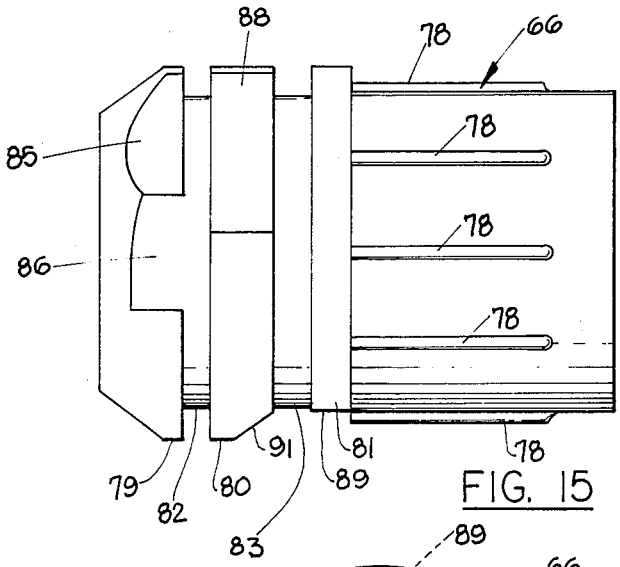
FIG. 15 is a side view of the polarizing shell of FIG. 13, as seen from the top of that figure.
Figure 19:
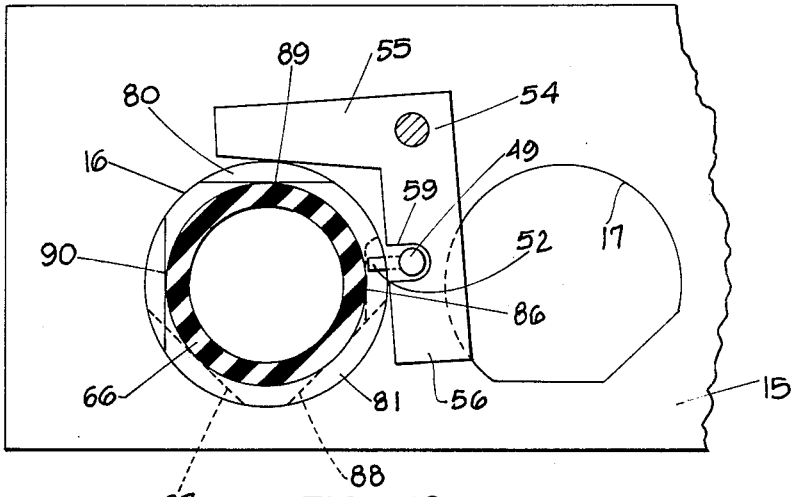
FIGS. 19–22 are sequential, simplified, fragmentary views illustrating the operation of the first latch and the first lock-out lever during insertion and rotation of the first two connectors in the panel assembly of the present invention.

Reference is now made to FIG. 19. FIG. 19 is a simplified, semi-diagrammatic representation of the panel assembly of the present invention with the front panel element removed to clearly show lock-out lever 54 and the nose 49 of the latch plunger of latch assembly 42. In FIG. 19, a cross-sectional view of polarizing shell 66, taken along section 19—19 of FIG. 14, is shown. The cable and connector 63, associated with polarizing shell 66, have been deleted for purposes of clarity.

Returning for a moment to FIG. 5, it will be apparent that the neutral cable connector and its polarizing shell cannot be inserted in front panel element opening 8 and intermediate panel element polarizing opening 17 because these openings are partially blocked by the leg 56 of lock-out lever 54. The lock-out lever 54 cannot pivot to a position wherein these openings are clear, because of the nose portion 49 of the plunger of latch assembly 42. Thus, the neutral connector and its polarizing shell cannot be inserted into the panel assembly before the ground connector and its polarizing shell are inserted into front panel element openings 7 and 16.

In FIG. 19, it is to be assumed that the polarizing shell 66 has been inserted to the extent that its front rib 79 has just passed through the polarizing opening 16 of intermediate panel element opening 15. It will be noted that polarizing shell 66 has been inserted in the panel with its flat 89 uppermost. As the polarizing shell 66 is inserted through opening 7 of front panel element 1 and opening 16 of intermediate panel element 15, the first polarizing shell rib 79 will shift the lock-out lever 54 to the position shown in FIG. 19. It will be noted that in this position the leg 55 of lock-out lever 54 clears the opening 16 (and opening 17, not shown), but the leg 56 thereof still blocks the opening 17 of intermediate panel element 15 (and the opening 8 of front panel element 1, not shown). This shifting of the lock-out lever 54 is made possible by the clearance notch 59. Further clockwise rotation of the lock-out lever 54 is precluded, however, by the latch assembly nose 49. When the forwardmost rib of polarizing sleeve 66 clears the opening 16 of intermediate panel element 15, the lock-out lever will be maintained in the position shown in FIG. 19 by the second rib 80 of the polarizing shell 66, the second rib 80 having the same diameter as the first rib 79.

As the first rib 79 of the polarizing shell 66 passes through opening 16 of intermediate panel element 15, the pin 52 of the latch plunger will pass through the notch 86 in the first rib until it abuts the forward face of the second polarizing shell rib 80.

Figure 20:
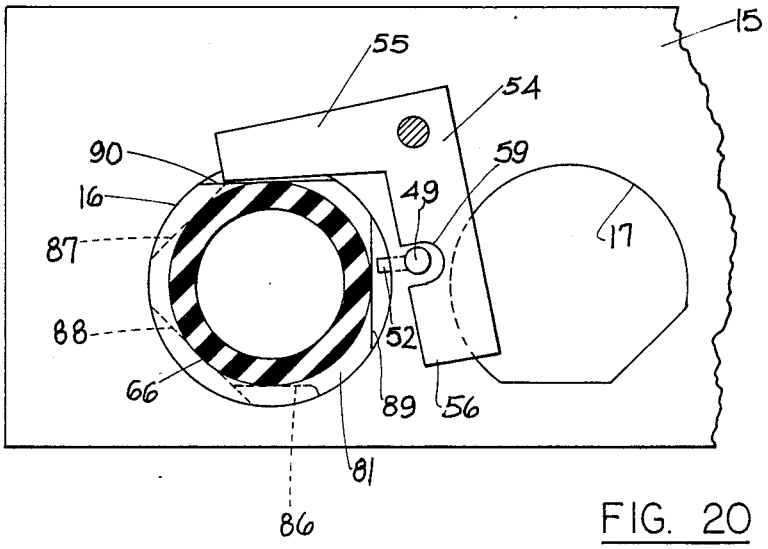

FIG. 6 shows the polarizing shell 66 having been inserted fully into the panel assembly. At this stage, the male contact of the male connector (not shown) associated with polarizing shell 66 is fully mated with the female contact (not shown) of receptacle 39. At the same time, intermediate polarizing shell rib 80 has shoved latch assembly pin 52 rearwardly retracting plunger 44 against the action of compression spring 53. This results in the nose portion 49 being retracted within perforation 22 of intermediate panel element 15, as is shown in full lines in FIG. 6. Thus, the latch assembly nose 49 no longer interferes with lock-out lever 54. Once the polarzing shell (and its associated connector) have been fully inserted into the panel assembly, the polarizing shell and its associated connector are rotated in a clockwise direction approximately 90°, as shown in FIG. 20. This rotation of the polarizing shell 66 and its associated connector accomplishes several things. First of all, it causes the male and female connectors to be locked together, as taught in the above mentioned U.S. Pat. No. Re. 25,506. Simultaneously, it causes the latch assembly 42 to be locked in its retracted position so that its nose portion 49 no longer interferes with rotation of the lock-out lever 54. Finally, it causes the flat 89 on the third rib 81 of polarizing shell 66 to face the leg 56 of lock-out lever 54, providing clearance for the lock-out lever leg 56.

Figure 21:
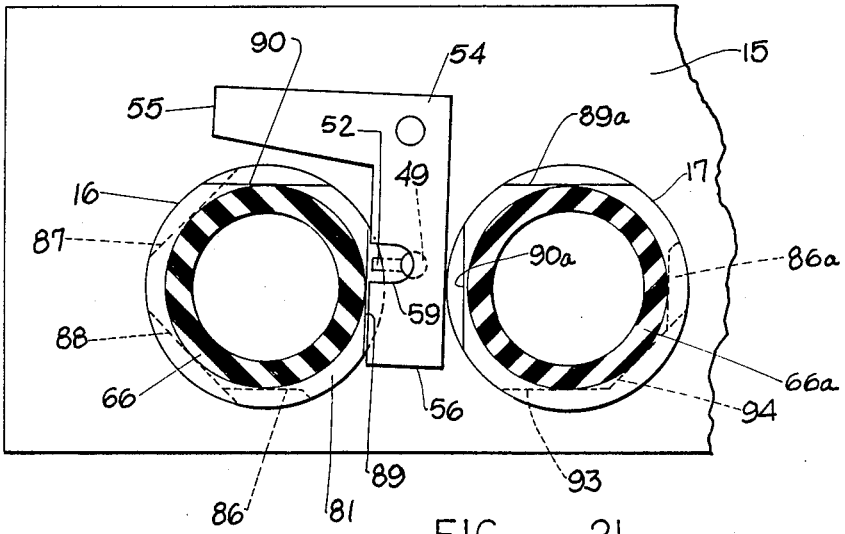
Figure 22:
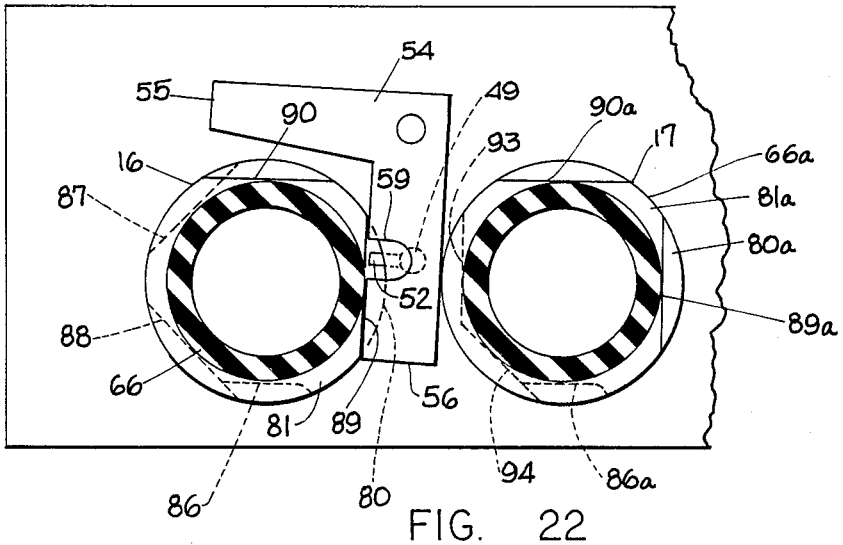

Once the polarizing shell 66 and its associated connector have been fully inserted and rotated 90°, as shown in FIG. 20, the next polarizing shell 66*a* and its associated connector for the neutral cable can now be inserted, as shown in FIG. 21. As the polarizing shell 66*a* and its polarizing connector are inserted in the opening 8 (not shown) of front panel element 1, and the polarizing opening 17 of intermediate panel element 15, the first and second ribs of polarizing shell 66*a* will shove the lock-out lever 54 to the position shown, clear of front panel element opening 7 and intermediate panel element opening 17. This is made possible by virtue of the fact that the nose portion 49 of the latch assembly is in retracted position, and clearance is provided by the flat 89 on the third rib 81 of polarizing shell 66.

When the polarizing shell 66*a* and its associated connector have been fully inserted and rotated 90° to lock the male and female contacts as described above, the leg 56 of lock-out lever 54 will be held against the flat 89 of polarizing shell 66 by the third rib 81*a* of polarizing shell 66*a*. It will be apparent from FIG. 22 that when the polarizing shell 66*a* and its associated connector have been fully inserted and rotated 90° so that the leg 56 of lock-out lever 54 is maintained in the position shown, the second or intermediate rib 80 of polarizing shell 66 lies behind the lock-out lever leg 56 and therefore polarizing shell 66 and its associated connector cannot be removed from the panel.

From the above description, it will be evident that the ground connector and its associated polarizing shell 66 must be inserted into the panel assembly and locked therein before the neutral connector and its associated polarizing shell 66*a* can be inserted. Once the neutral connector and its associated polarizing shell 66*a* have been inserted and locked in position, the ground connector and its associated polarizing shell cannot be removed from the panel assembly.

It will now be apparent that since all of the lock-out levers, latch assemblies, and polarizing shells and their associated cables function in the same manner, the ground cable, neutral cable, first line cable, second line cable, and third line cable must be connected to the panel assembly in that order. Similarly, the cables can be disconnected from the panel assembly only in the reverse order, the third line cable first, and the ground cable last. If only one or two line cables are used, the panel assembly will still function in the same manner.

Figure 23:
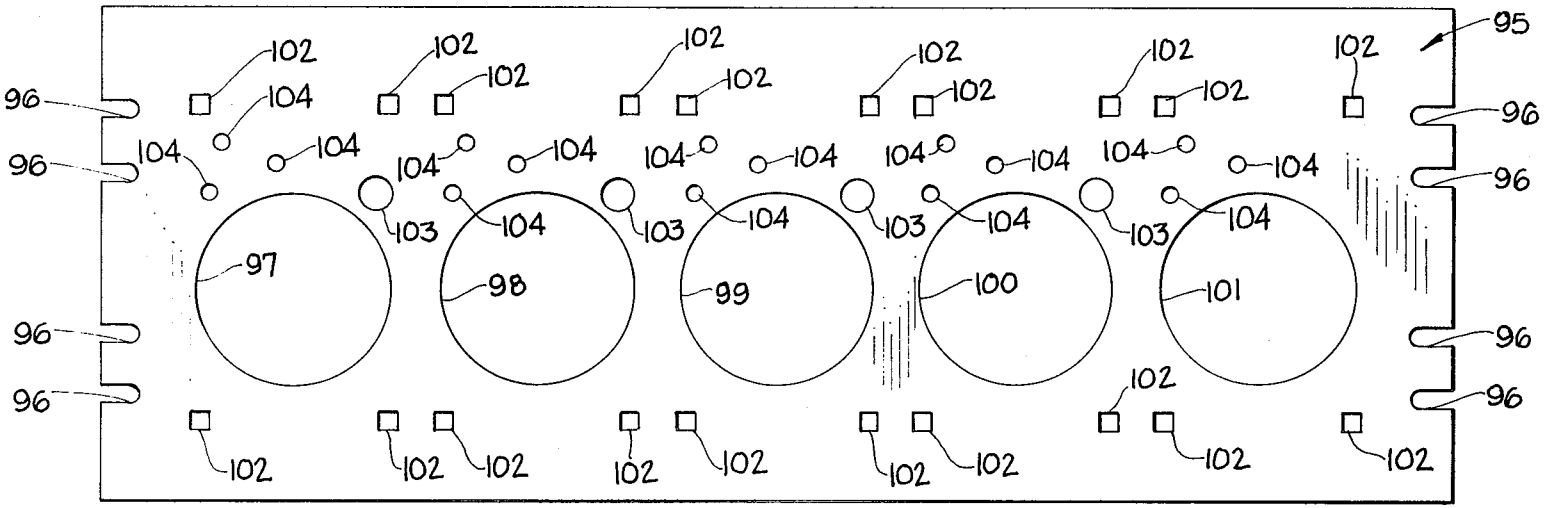
FIG. 23 is an elevational view of the front panel element of a second embodiment of the panel assembly of the present invention.
Figure 78:
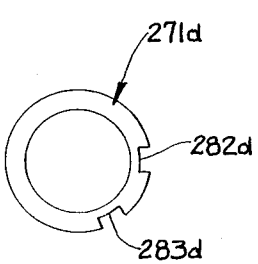
FIGS. 74 through 78 are simplified, semi-diagrammatic front elevations of the polarizing shell of FIG. 71 and four other polarizing shells for use in a panel assembly of the present invention having receptacle housing assemblies of the type illustrated in FIG. 63.
Figure 77:
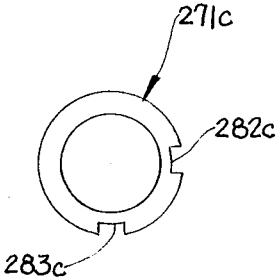
Figure 76:
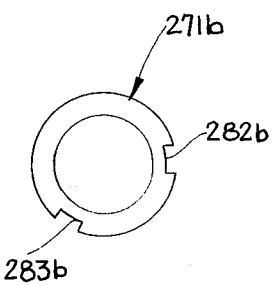
Figure 75:
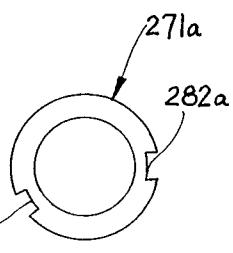

A second and preferred embodiment of the panel assemby of the present invention is illustrated in FIGS. 23 through 78, wherein again like parts have been given like index numerals.

The preferred embodiment comprises a panel element, generally indicated at 95 in FIG. 23. Panel element 95 comprises a planar member provided with slots 96 at its ends, for the receipt of fastening means (not shown) by which it may be affixed to any desired structure, rack, console, or surface. Panel element 95 is provided with five circular openings 97 through 101 adapted to receive connector-polarizing shell assemblies to be described. The openings 97 through 101 are intended to accommodate the connector-polarizing shell assemblies of the ground cable, the neutral cable, and the first, second and third line cables, respectively. A series of square perforations 102 are provided for the receipt of carriage bolts, by which a receptacle housing (to be described) is mounted to the rear surface of panel element 95 behind each of the openings 97 through 101. Perforations 103 are provided in panel element 95, each accommodating a locking pin, to be described. Finally, the panel element 95 is completed by the provision of a cluster of three perforations 104 adjacent each of the openings 97 through 101, enabling the mounting of front cover hinge brackets to be described.

Figure 24:
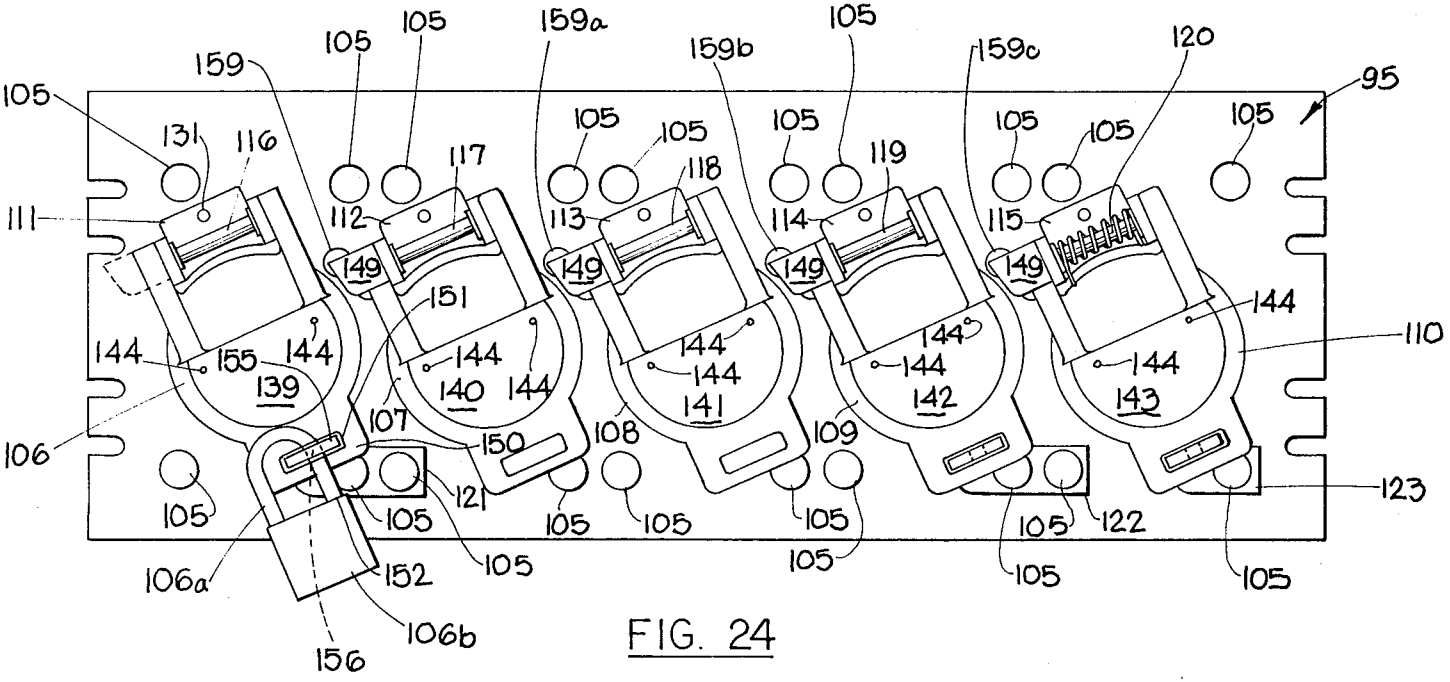
FIG. 24 is an elevational view of the front panel element of FIG. 23 with the front covers and associated hardware mounted thereon.

FIG. 24 illustrates panel element 95 in its completed form. Carriage bolts 105 are shown in each of the square openings 102 (see FIG. 23) mounting a receptacle housing (not shown) behind each of openings 97 through 101. A series of covers 106 through 110 are mounted over each of the openings 97 through 101 by means of hinge brackets 111 through 115. The covers 106 through 110 are pivotally attached to hinge brackets 111 through 115, respectively, by means of identical hinge pins 116 through 120. Finally, covers 106, 109, and 110 are provided with locking brackets 121, 122 and 123, respectively.

Figure 25:
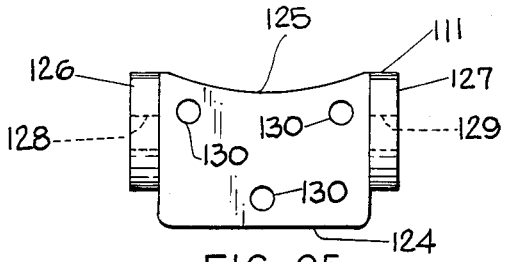
FIGS. 25, 26 and 27 are respectively plan, front elevation and side views of a front cover hinge bracket.
Figure 26:
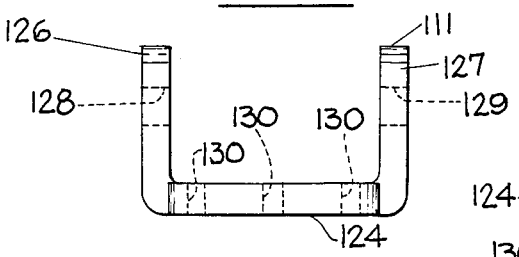
Figure 27:
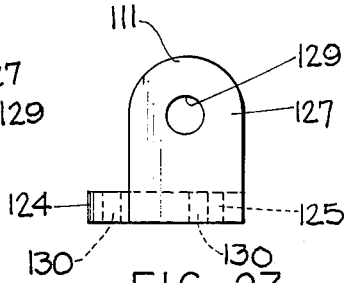

Reference is now made to FIGS. 25 through 27, wherein the hinge bracket 111 is shown. Hinge bracket 111 comprises a base 124 of substantially rectangular configuration. The forward longitudinal edge of base 124 is inset in a slightly curved manner, as at 125 to accommodate the cover pivotally attached to bracket 111. The side edges of base portion 124 terminate in upstanding ears 126 and 127 which constitute an integral one-piece part of bracket base portion 124. Ears 126 and 127 have coaxial perforations 128 and 129, respectively, therein for the receipt of hinge pin 116 (see FIG. 24). The hinge bracket 111 is completed by the provision of three perforations 130 in base portion 124. The perforations 130 correspond to perforations 104 in panel element 95 and are arranged in a similar cluster of three. By this means, hinge bracket 111 is affixed to panel element 95 by screws, one of which is shown at 131 in FIG. 24. It will be understood that hinge brackets 112 through 115 are identical to hinge bracket 111.

Figure 30:
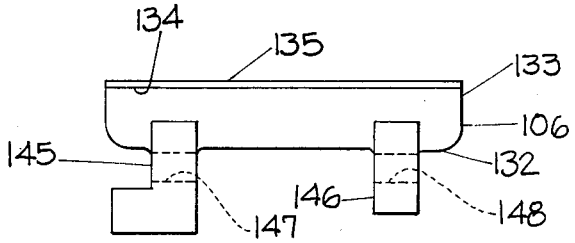
FIGS. 28, 29 and 30 are respectively plan, side elevation and end elevation views of a front cover.
Figure 29:
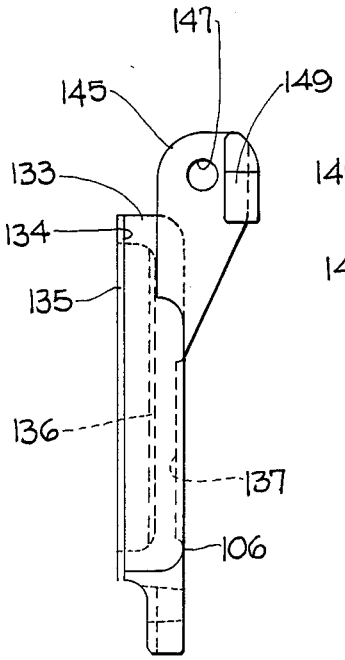
Figure 28:
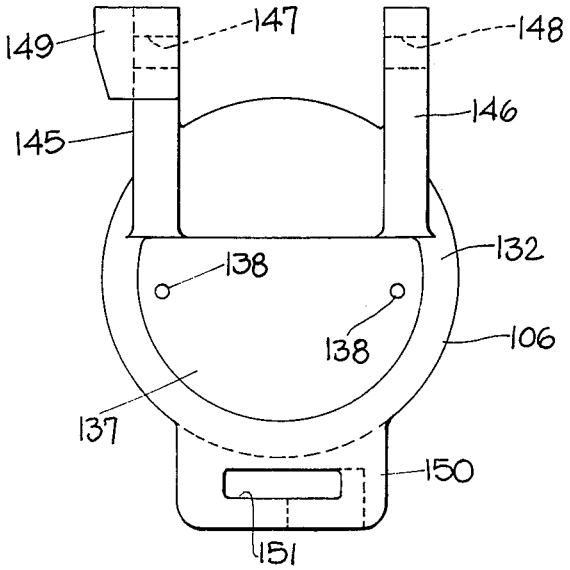

Cover 106 is illustrated in FIGS. 28 through 30. Since all of covers 107 through 110 are identical to cover 106, a description of cover 106 may be considered to be a description of each of the covers 107 through 110.

The cover 106 comprises a substantially circular body 132 having a rearwardly extending annular flange portion 133. The flange portion 133 terminates in a planar annular surface 134 provided with an annular gasket 135 of insulative material, affixed thereto by adhesive means or the like. Similarly, a thin layer 136 of insulative material is adhesively adhered to the inside surface of the cover body portion 132. The outside surface of body portion 132 has a shallow depression 137 formed therein. As is apparent from FIG. 28, the depression 137 is slightly greater than semi-circular. The cover 106 is provided with a pair of perforations 138 at the position of depression 137. The depression 137 is adapted to receive a correspondingly shaped planar plate. Such plates are shown at 139 through 143 for each of the covers 106 through 110 in FIG. 24. The plates 139 through 143 are held in place by pins 144 passing through the plates and having an interference fit in cover perforations 138. Each of the plates 139 through 143 may be color coded and may carry indicia indicating which connector is to be inserted in each of the perforations 97 through 101 located behind covers 106 through 110, respectively. The connectors, themselves, or their polarizing shells, or both, may be similarly color coded.

A pair of extensions 145 and 146 extend upwardly from the body portion 132 of cover 106 as viewed in FIG. 28. The extensions 145 and 146 constitute an integral one-piece part of the cover 106 and are arranged in parallel spaced relationship. Extensions 145 and 146 are provided with perforations 147 and 148, respectively. The extensions 145 and 146 are so spaced from each other as to just nicely receive the ears 126 and 127 of hinge bracket 111 therebetween. When cover 106 is hingedly affixed to its bracket 111, the perforations 147 and 148 are coaxial with the bracket perforations 128 and 129, and the hinge pin 46 extends through these coaxial perforations. It will be noted that the extension 145 has a lateral flange 149. The purpose of flange 149 will be apparent hereinafter.

The cover 106 has yet another extension 150, diametrically opposed to the extensions 145 and 146. The extension 150 constitutes an integral one-piece part of the cover body 132. The extension 150 has an elongated slot 151 formed therein. The extension 150 and its slot 151 are adapted to cooperate with a locking bracket, next to be described.

Figure 32:
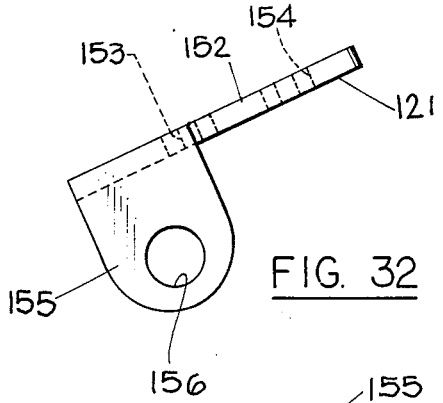
FIGS. 31 and 32 are respectively a plan view and an elevational view of a front cover locking bracket.
Figure 31:
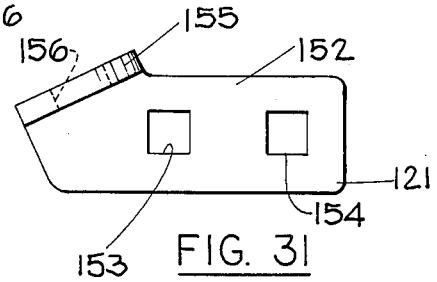
Figure 36:
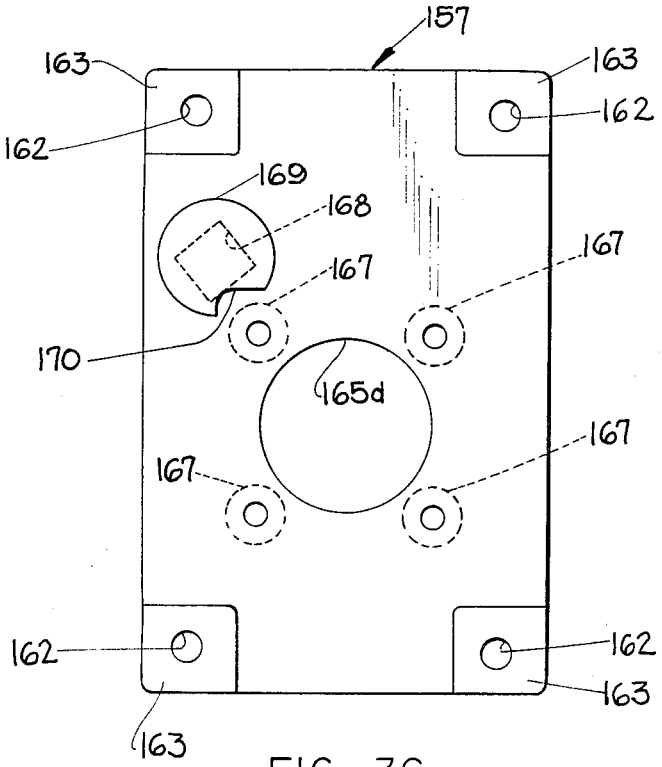
FIG. 36 is a rear elevational view of the female receptacle housing of FIG. 33.

Locking bracket 121 is illustrated in FIGS. 31 and 32. Locking bracket 121 comprises a planar base portion 152 having a pair of square openings 153 and 154 formed therein. The openings 153 and 154 correspond in size and spacing to an adjacent pair of the square panel element openings 102 (see FIG. 23). In this way, the base portion 152 of locking bracket 121 can be affixed to the forward face of panel element 95 by a selected pair of carriage bolts 105 used to affix the receptacle housings to the rearward surface of panel element 95.

The base portion 152 of locking bracket 121 terminates at one end in an angularly related, upstanding ear 155 having a perforation 156.

As is most clearly ascertainable from FIG. 24, the upstanding locking bracket ear 155 extends through the slot 151 of cover 106 when the cover is in its closed position. The shackle **106*a* of a padlock 106*b* or other appropriate locking means, can be engaged in the perforation 156 of locking bracket 121 to lock cover 106** in its closed position.

It will be apparent from FIG. 24 that locking bracket 122 is identical to locking bracket 121. Locking bracket 123 differs from locking bracket 121 only in that its base portion is shorter and it is provided with a single rectangular perforation for the receipt of a single carriage bolt.

One final note with respect to FIG. 24, it should be noticed that while all of covers 106 through 110 are identical, the lateral lug 149 of cover 106 can be eliminated, if desired, since it would serve no function, as will be explained hereinafter.

Figure 33:
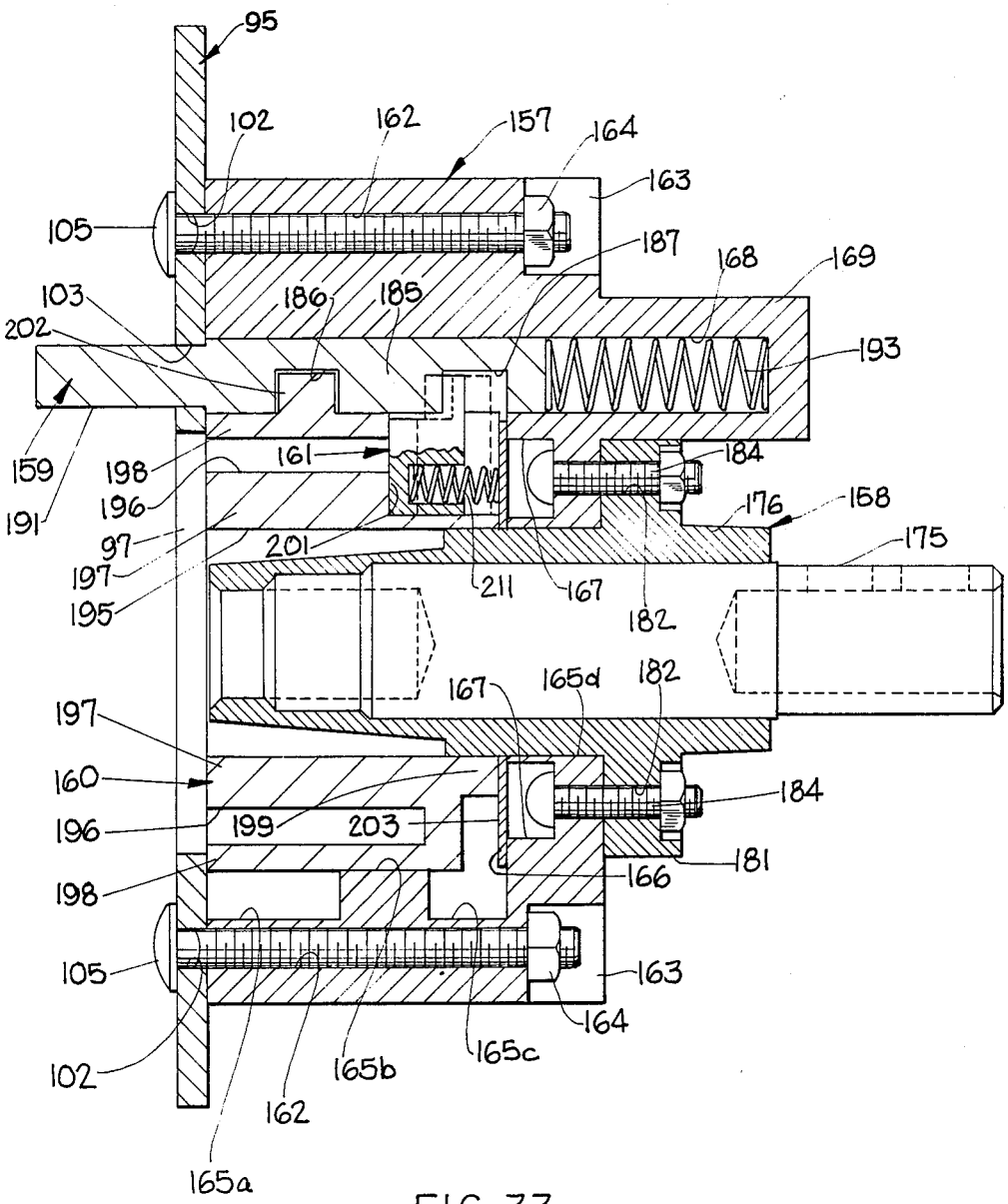
FIG. 33 is a cross sectional view of a receptacle housing with all of its elements mounted therein, including a female receptacle.

Reference is now made to FIG. 33. FIG. 33 illustrates an exemplary receptacle housing, one of which is mounted on the rear surface of panel element 95 behind each of the openings 97 through 101. For purposes of an exemplary showing, the receptacle housing, generally indicated at 157, may be considered to be that receptacle housing mounted behind panel element opening 97 for the ground receptacle. Since the receptacle housings behind each of the openings 98 through 101 are identical, a description of housing 157 can serve as a description of all of the receptacle housings. In FIG. 33, the panel element 95 is shown together with its opening 97. For purposes of clarity, the cover 106 for opening 97 has been deleted.

Receptacle housing 157 is shown in FIG. 33 as containing a female receptacle, generally indicated at 158, a locking pin generally indicated at 159, a female rotating ring generally indicated at 160, and a locking latch generally indicated at 161. Each of these elements will be described in their turn. Reference is first made to FIGS. 33 through 36, wherein the receptacle housing 157 is shown. Receptacle housing 157 comprises a substantially rectangular structure preferably molded of insulative plastic material or the like. Adjacent its four corners, receptacle housing 157 is provided with perforations 162. At the rear of the receptacle housing 157, the perforations 162 terminate in recesses 163. Referring to FIGS. 23 and 24, the receptacle housing 157 is attached to the rear surface of panel element 195 by carriage bolts 105 passing through the four square panel openings 102 nearest opening 97. Two such carriage bolts 105 are shown in FIG. 33. The recesses 163 accommodate nuts 164 for carriage bolts 105.

Figure 35:
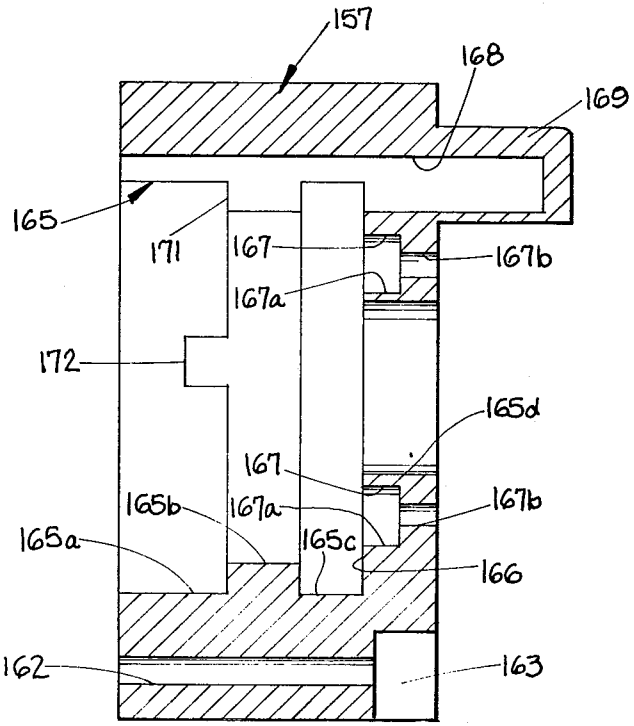
FIG. 35 is a cross sectional view of the female receptacle housing, taken along section line 35—35 of FIG. 34.
Figure 34:
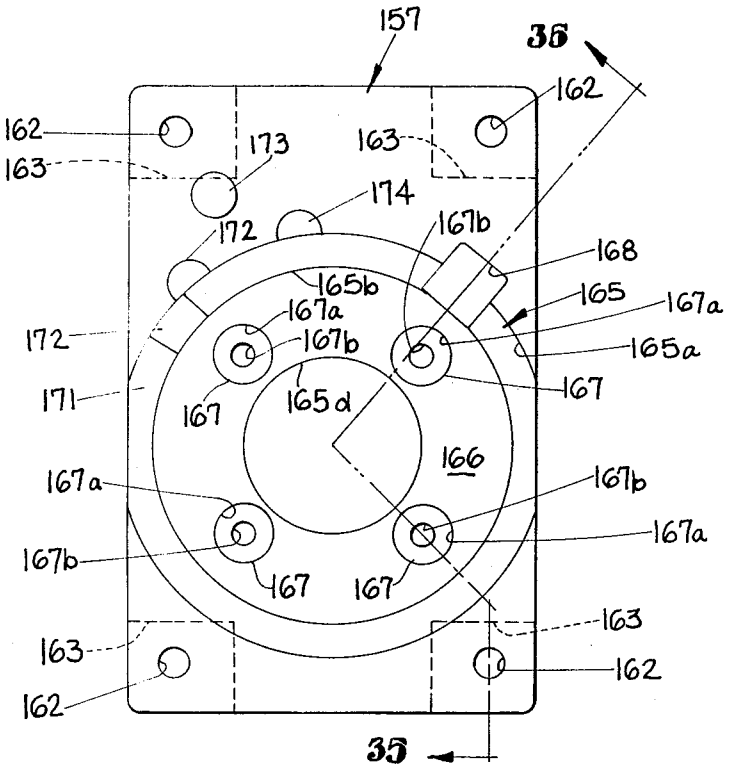
FIG. 34 is a front elevational view of the female receptacle housing of FIG. 33.

As is most clearly shown in FIGS. 34 and 35, the receptacle housing 157 has a circular bore extending therethrough from its forward face to its rearward face. The bore is generally indicated at 165 and is made up of bore portions of differing diameters. The first bore portion **165*a* is located nearest the forward surface of the housing and has a diameter slightly greater than the width of the housing, as is shown in FIG. 35. The next bore portion 165*b* is of a diameter slightly less than the width of the receptacle housing. The third bore portion 165*c* is of the same diameter as the first portion 165*a*. The final portion 165*d*, nearest the rear surface of the receptacle housing 157**, has the smallest diameter of any of the bore portions.

Bore portions **165*c* and 165*d* define an annular shoulder 166 therebetween. A series of four perforations 167 are evenly spaced about bore portion 165*d* and extend from shoulder 166 to the rear surface of receptacle housing 157. The perforations 167 have a first large diameter portion 167*a* and a second smaller diameter portion 167*b***.

A bore of rectangular cross section is shown at 168. It will be noted that the rectangular bore 168 intersects bore portions **165*a*, 165*b*, and 165*c*. A portion of rectangular bore 168 continues into an extension 169 protruding from the rear surface of receptacle housing 157. The extension 169 may have a relief 170 formed therein (see FIG. 36**) to make room for the receptacle flange, to be described hereinafter.

The main bore portions **165*a* and 165*b* define therebetween a shoulder 171. The shoulder 171 has a stop lug 172 formed thereon and extending into bore portion 165*a***.

The receptacle housing is completed by the provision of three depressions 172 through 174 formed in its forward face (see FIG. 34). When receptacle housing 157 is mounted behind panel element opening 97, the depressions 172 through 174 are located directly behind the adjacent cluster of three panel element openings 104 so as to accommodate screws 131 by which the cover hinge bracket 111 is affixed to the front face of panel element 95.

Figure 37:
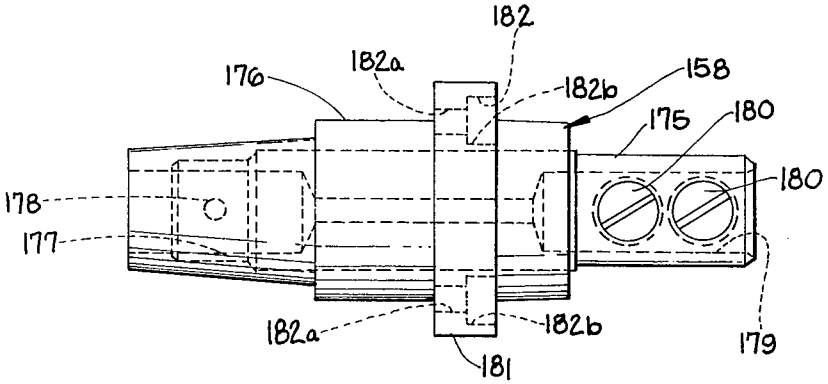
FIG. 37 is a elevational view of a female receptacle to be used with the housing of FIGS. 33 through 36.
Figure 38:
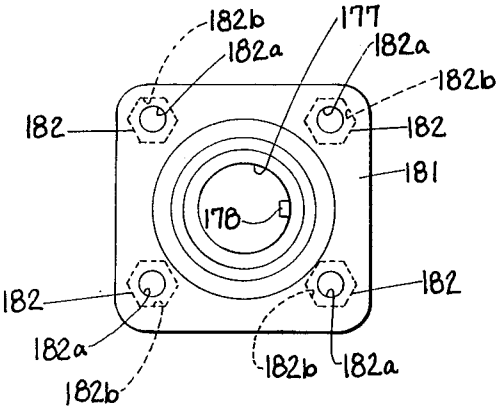
FIG. 38 is a front elevational view of the female receptacle of FIG. 37.

Female receptacle 158 is shown in FIGS. 37 and 38. Receptacle 158 is substantially conventional and comprises a female contact 175 surrounded by an insulative body 176. The female contact may be of the type generally taught in the above mentioned U.S. Pat. No. Re. 25,506. The female contact has at its forward end a central bore or socket 177 adapted to receive the male contact. The socket 177 has an inwardly projecting pin 178 extending inwardly from its wall, adapted to cooperate with an L-shaped groove in the male contact to lock the contacts in mated condition, as will be described hereinafter. At its rearward end, the female contact may be connected to a bus bar, a cable or the like. For purposes of an exemplary showing, the female contact is illustrated as having a cable receiving socket 179. The cable (not shown) is maintained in socket 179 by a pair of set screws 180.

Insulative body 176 is provided with a rectangular flange 181. The rectangular flange 181 has near its corners four identical bores 182. Each bore 182 has a small bore portion **182*a* and a large bore portion 182*b*** which may be hexagonal in cross-sectional configuration.

Figure 39:
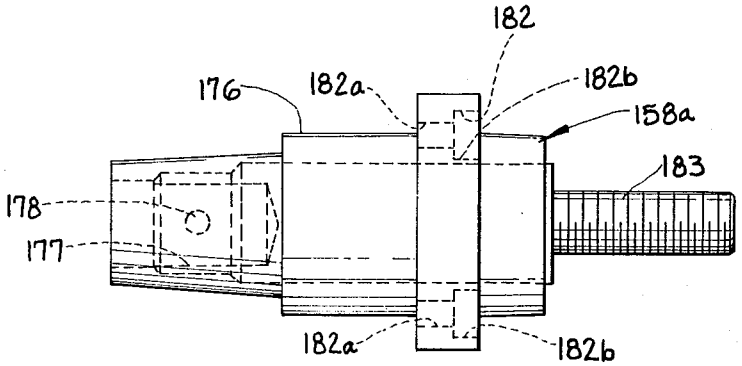
FIG. 39 is an elevational view, similar to FIG. 37, illustrating another embodiment of female receptacle.

FIG. 39 illustrates a second embodiment of a female receptacle which may be employed in the present invention. The receptacle of FIG. 39 is similar to that of FIG. 37 and like parts have been given like index numerals. The receptacle of FIG. 39 differs from that of FIG. 37 only in that the rearward end of the female contact 175 terminates in a threaded stud 183, as is also well known in the art.

Returning to FIG. 33, the female receptacle 158 is affixed to the receptacle housing 157. To this end, the forward portion of receptacle 158 is inserted through receptacle housing bore portion **165*d* and extends forwardly through receptacle housing bore portions 165*a*, 165*b*, and 165*c* nearly to the rear surface of panel element 95. The receptacle flange 181 of receptacle 158 is affixed to the rear surface of receptacle housing 157 by bolts 184 passing through receptacle housing perforations 167 and receptacle flange perforations 182**.

Figures 40, 41, 42, 43, 44, 45, 46:
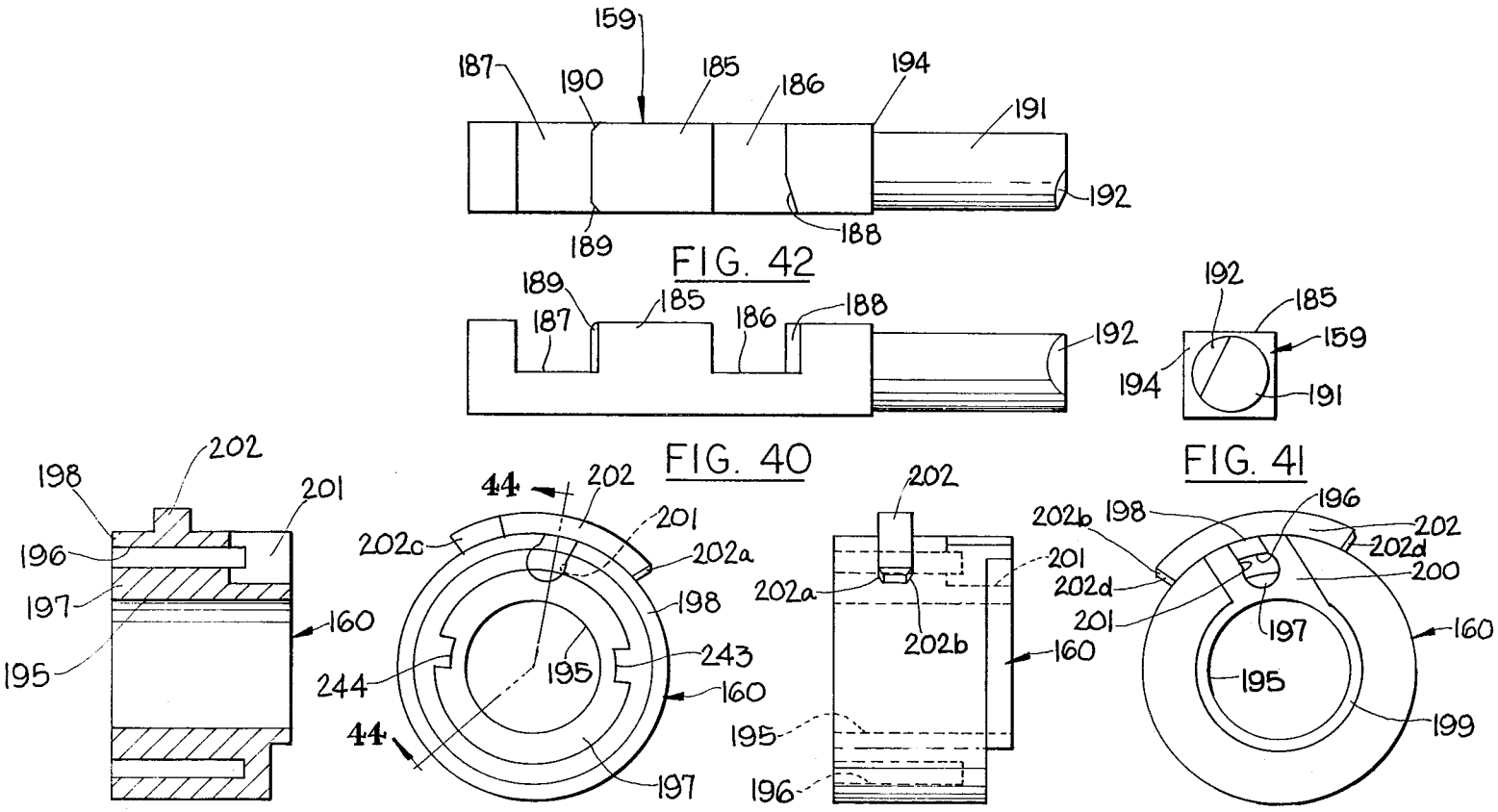
FIG. 40 is an elevational view of the locking pin of the receptacle housing of FIG. 33.
FIG. 41 is an end elevational view of the locking pin as seen from the right of FIG. 40.
FIG. 42 is a plan view of the locking pin of FIG. 40.
FIG. 43 is a front elevational view of the female rotating ring of the receptacle housing of FIG. 33.
FIG. 44 is a cross sectional view taken along section line 44—44 of FIG. 43.
FIG. 45 is a side elevational view of the female rotating ring of FIG. 43, as seen from the right of that figure.
FIG. 46 is a rear elevational view of the female rotating ring.

The locking pin 159 of FIG. 33 is illustrated in FIGS. 40 through 42. Locking pin 159 comprises a bar-like body 185 of rectangular cross section. The body 185 has a pair of notches 186 and 187 formed therein. One side of notch 186 is relieved as at 188. Both sides of notch 187 are relieved as at 189 and 190. At its forward end, the body 185 terminates in a cylindrical nose portion 191. Nose portion 191 preferably constitutes an integral, one-piece part of body 185. The forward end of nose portion 191 is slightly relieved, as at 192.

FIG. 33 illustrates the locking pin 159 slidably mounted in the rectangular bore 168 of receptacle housing 157. The nose portion 191 of locking pin 159 extends slidably through that one of the perforations 103 in panel element 95 located nearest opening 97. In FIG. 33, the locking pin 159 is shown in its forwardmost position, to which it is constantly biased by compression spring 193. The forwardmost position of locking pin 159 is determined by the abutment of the rear surface of panel element 95 by the shoulder 194 formed between the locking pin nose portion 191 and the locking pin body portion 185.

The female rotating ring 160 of FIG. 33 is shown in detail in FIGS. 43–46. The female rotating ring comprises a generally cylindrical member having an axial bore 195. The wall of the female rotating ring is also provided with an annular groove 196. The central bore 195 and the annular groove 196 define an inner annular wall 197 and an outer annular wall 198.

As is most clearly shown in FIGS. 45 and 46, the rear surface of the female rotating ring has a narrow annular wall 199 surrounding the central bore 195. The narrow annular wall 199 has an extension 200 which extends to the periphery of the female rotating ring at an angle, as is shown in FIG. 46. The extension 200 also has a socket 201 formed therein, which socket extends partway into annular walls 197 and 198 and intersects the annular groove 196. The socket 201 extends at the same angular relationship as extension 200. Near its upper end, as viewed in FIG. 46, its side walls are parllel. The remainder of the socket is substantially cylindrical. Near socket 201, the peripheral surface of outer wall 198 carries an integral, arcuate lug 202. The lug 202 is slightly relieved at one end, as at **202*a* and 202*b* in FIG. 45. The lug 202 is more heavily relieved at the other end, as is shown at 202*c* in FIG. 43 and 202*d* in FIG. 46**.

FIG. 33 illustrates the female rotating ring 160 mounted in position within the receptacle housing 157. It will be noted in FIG. 33 that a thin annular washer of insulative material 203 is mounted on the forward portion of receptacle body 176 and is located adjacent the shoulder 166, covering perforations 167 therein. The female rotating ring 160 is rotatively mounted on the forward portion of the receptacle body 176, the forward portion extending into the central bore 195 of the female rotating ring 160. The annular wall 199 on the rearward surface of the female rotating ring 160 abuts the washer 203. The forward edge of the outer wall 198 of the female rotating ring abuts the rear surface of panel element 95, so that the female rotating ring is rotatively and captively mounted within the receptacle housing 157. It will be noted in FIG. 33 that the annular groove 196 of the female rotating ring is exposed through panel element opening 97. The arcuate lug 202 of the female rotating ring is receivable within the forward notch 186 of locking pin 159. Finally, the female rotating ring is further stabilized by the bore portion **165*b* of receptacle housing 157. The diameter of receptacle housing bore portion 165*b* and the exterior diameter of the female rotating ring are such as to permit rotation of the female rotating ring relative to the bore portion 165*b***. The female rotating ring lends itself well to being molded as an integral, one-piece part, of insulative plastic material or the like.

Figure 47:
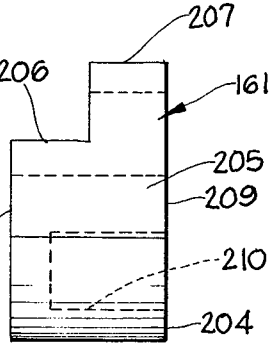
FIG. 47 is an elevational view of the locking latch of the receptacle housing of FIG. 33.
Figure 48:
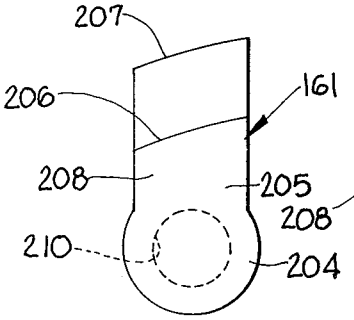
FIG. 48 is an end elevational view of the locking latch, as seen from the left of FIG. 47.

Reference is now made to FIGS. 47 and 48 wherein the locking latch 161 is shown. The lower portion 204 of the locking latch body is substantially cylindrical, as is most apparent from FIG. 47. The remainder 205 of the locking latch body extends upwardly from the cylindrical portion 204 with parallel sides. Body portion 205 terminates at its upper end in two arcuate surfaces 206 and 207. The forward and rearward ends 208 and 209 of the locking latch are planar. The locking latch is provided with an axial bore 210 in its cylindrical body portion 204. The bore 210 extends from the rearward end 209 of the locking latch toward but not through the forward end 208.

The locking latch 161 is adapted to be slidably mounted in the female rotating ring socket 201. The locking latch 161 is shown so mounted in socket 201 in FIG. 33. The locking latch 161 is constantly urged forwardly in socket 201 by a compression spring 211 located within the locking latch bore 210. One end of compression spring 211 abuts the closed forward end of bore 210. The other end of compression spring 211 abuts the washer element 203. When the locking latch 161 is mounted in the female rotating ring socket 201, its arcuate surface 206 constitutes a continuation of the peripheral surface of the female rotating ring outer wall 198. That portion of the locking latch terminating in surface 207 extends upwardly from the peripheral surface of the female rotating ring outer wall 198 by an amount substantially the same as the arcuate female rotating ring lug 202 and the latch surface 207 corresponds to the outer surface of the arcuate female rotating ring lug 202.

It should further be noted from FIG. 33 that the locking latch 161, under the urging of compression spring 211, normally occupies a position in socket 201 such that the upstanding portion of the locking latch extends somewhat forwardly and out of alignment with the rearward notch 187 of locking pin 159. However, the locking latch 161 is shiftable rearwardly in socket 201, against the action of compression spring 211, to a position wherein its upstanding portion, terminating in surface 207, is in alignment with the notch 187 of locking pin 159.

The purpose and function of the female receptacle 158, locking pin 159, female rotating ring 160 and locking latch 161 will be set forth hereinafter.

Figure 60:
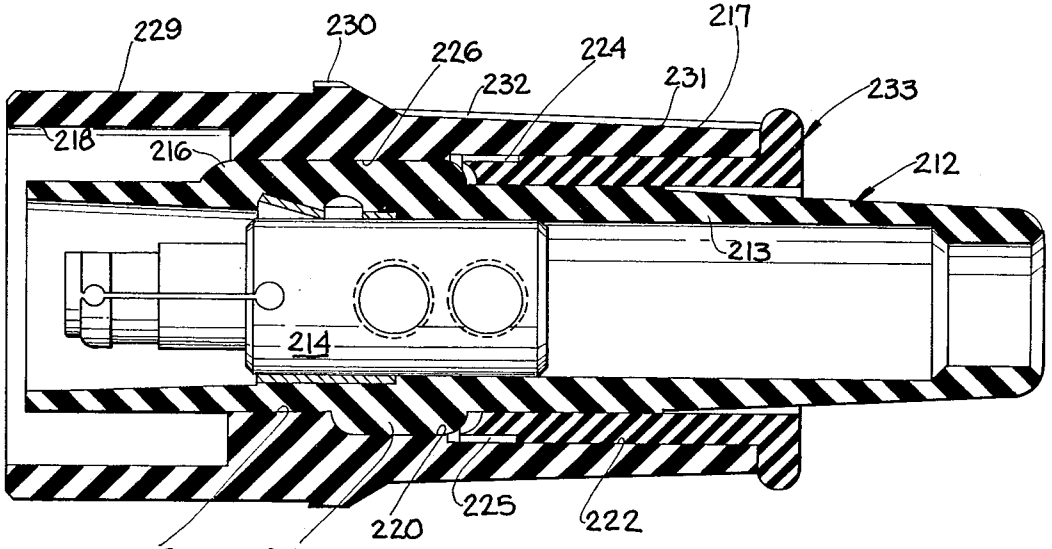
FIG. 60 is a cross sectional view taken along section line 60—60 of FIG. 59.

Reference is now made to FIGS. 49 through 51 and 60. In FIG. 60, a male connector is shown which is identical to the male connector 63 of FIG. 18. Thus, the connector, generally indicated at 212, comprises an insulative housing 213 and a male contact 214. The exterior of the insulative housing 213 has an annular raised portion 215 equivalent to the annular raised portion 74 in FIG. 18. The annular raised portion 215 has a forward extension 216 equivalent to the forward extension 75 in FIG. 18.

Figure 49:
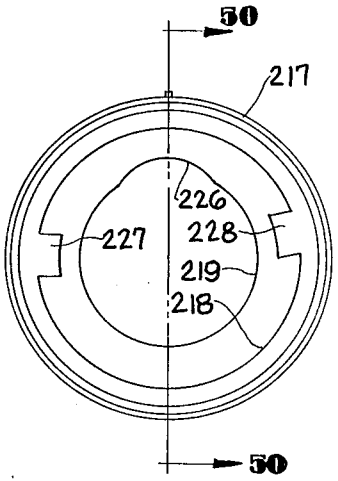
FIG. 49 is a front elevational view of a polarizing shell for a male connector.
Figure 50:
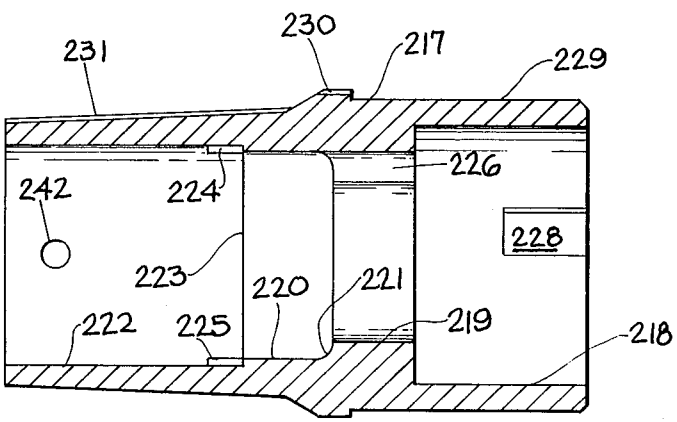
FIG. 50 is a cross sectional view taken along section line 50—50 of FIG. 49.
Figure 51:
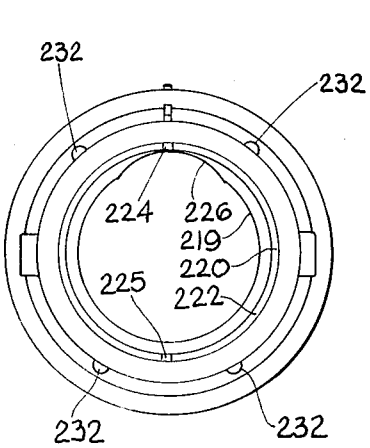
FIG. 51 is a rear elevational view of the polarizing shell of FIG. 49.
Figure 52:
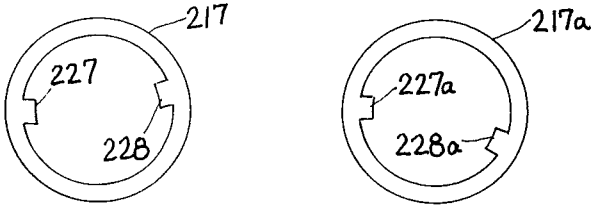
FIGS. 52 through 56 are simplified, semi-diagrammatic, front views of the polarizing shell of FIG. 49 and four other polarizing shells to be used with the panel assembly of FIGS. 23 and 24.
Figure 53:
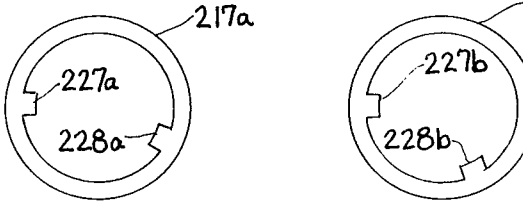
Figure 54:
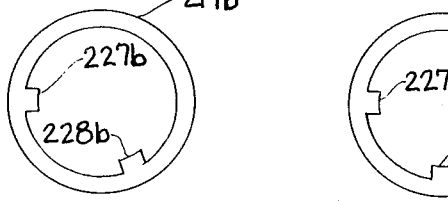
Figure 55:
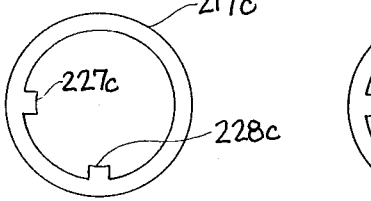
Figure 56:
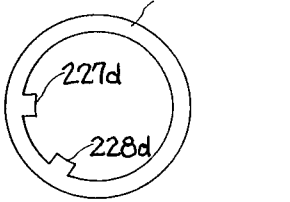

FIGS. 49 through 51 illustrate a polarizing shell 217 for the male connector 212. The polarizing shell 217 comprises a generally cylindrical member having an axial bore. The axial bore has a large diameter portion 218 near the forward end of the polarizing shell. Bore portion 218 is followed by bore portion 219 of lesser diameter. Bore portion 219 is followed by bore portion 220 having a diameter greater than bore portion 219, but less than bore portion 218. An arcuate shoulder 221 is formed between bore portions 219 and 220. Finally, a rearward bore portion 222 has a diameter slightly greater than bore portion 220 but again less than that of bore portion 218. Bore portions 220 and 222 form an annular shoulder 223. A pair of small, diametrically opposed keys 224 and 225 extend rearwardly from shoulder 223. It will further be noted that bore portion 219 is relieved as at 226. The bore portion 218 has formed on its inner surface a pair of polarizing lugs 227 and 228. The polarizing lugs 227 and 228 serve much the same purpose as polarizing flats 84–87 and 85–88 on polarizing shell 66 of FIG. 16, as will be described hereinafter.

The forward exterior surface 229 of polarizing shell 217 is of uniform cylindrical configuration. The surface 229 is followed by a surface 230 of slightly greater diameter, the surface 230 tapers rearwardly and inwardly to the rearward exterior surface 231 of polarizing shell 217, which surface tapers gently rearwardly and inwardly, as shown in FIG. 50. The rearward exterior surface 231 of polarizing shell 217 may be provided with a plurality of longitudinal ribs 232 (see FIG. 51) by which the polarizing shell-connector assembly may be more easily manually grasped and rotated.

The polarizing shell 217 is shown in FIG. 60 mounted on connector 212. The connector 212 is inserted into the polarizing shell 217 from the rear and is shifted forwardly therein until the forward end of the annular raised portion 215 of the connector housing abuts the arcuate internal shoulder 221 of polarizing shell 217. This abutment precludes further forward movement of the connector with respect to the polarizing shell 217. The relief 226 in the polarizing shell accommodates the forward e tension 216 of the connector housing 213. The forward extension 216 and the relief 226 cooperate to prevent relative rotation of the connector 212 and the polarizing shell. The connector 212 is locked in its fully seated position within polarizing shell 217 by a back ring assembly, generally indicated at 233 in FIG. 60.

Figure 57:
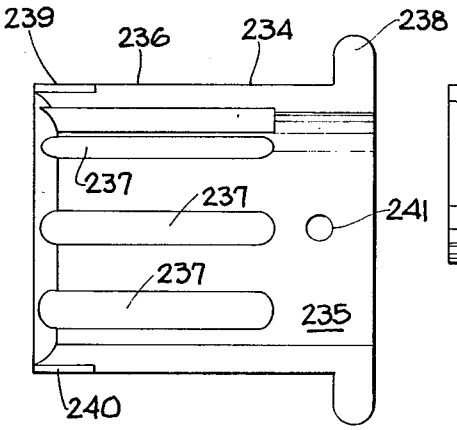
FIG. 57 is an elevational view of a polarizing shell back ring half.
Figure 58:
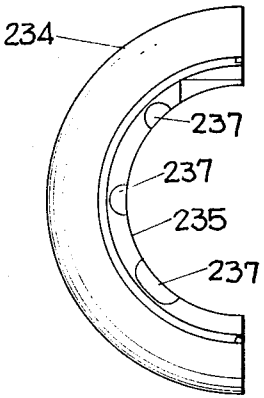
FIG. 58 is a rear view of the back ring half of FIG. 57.
Figure 69:
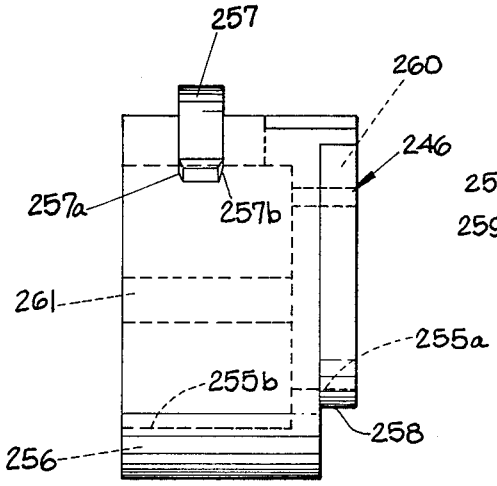
FIG. 69 is a side elevational view of the male rotating ring of FIG. 67, as seen from the right of that figure.

Back ring assembly 233 comprises two identical, mirror image halves. One-half 234 of back ring assembly 233 is illustrated in FIGS. 57 and 58. The back ring half 234 comprises a semi-cylindrical element having an interior surface 235 and an exterior surface 236. When the second mirror image half (not shown) is mated with the half 234, the interior surface 235 forms one half of a central bore adapted to receive the rearward portion of connector housing 212. With the halves mated, the exterior surface 234 constitutes one-half of the cylindrical peripheral surface of the back ring assembly, of such diameter as to be just nicely received in the bore portion 222 of polarizing shell 217, as is shown in FIG. 60. The interior surface 235 may be provided with longitudinal recesses to accommodate ribs normally formed on the exterior surface 231 of the rearward portion of connector housing 212. The back ring half 234 is provided with a lateral flange 238 at its rearward end. At its forward end, back ring half 234 is provided with a diametrically opposed pair of keyway halves 239 and 240. When the two back ring halves are mated, these keyways accept the keys 224 and 225 formed on the interior surface of the polarizing shell 217, assuring that the back ring halves are properly oriented.

Finally, each back ring half is provided with a perforation 241. When the back rings are assembled and located in place as shown in FIG. 60, the perforations 241 coincide with similar perforations in polarizing shell 217 (one of which is shown at 242 in FIG. 50). The perforations 241 and 242 are adapted to receive self-tapping screws by which the back ring assembly is attached to the polarizing shell 217. In this way the polarizing shell 217 is effectively fixed on the connector 212.

The second preferred embodiment of the present invention having been fully described, its operation can now be set forth.

Reference is first made to FIGS. 24 and 33. FIG. 33 illustrates the receptacle housing mounted on the rear surface of panel element 95 behind the first cover 139. FIG. 33 can also be considered to represent the receptacle housing and its appurtenances behind each of the additional covers 140 through 143.

FIG. 33 illustrates the receptacle housing 157 and its appurtenances in their normal condition in the absence of a connector. Locking pin 159 is in its fully extended position and is locked therein by engagement of the female rotating ring lug 202 in the locking pin groove 189. The forwardmost end of locking pin 159 is illustrated in FIG. 24 as underlying lateral flange 149 of cover 140. With the locking pin 159 extended beneath the flange 149 of cover 140, cover 140 is precluded from being opened. It will be understood that this will be true of all of covers 141, 142 and 143 as well, each of their flanges 149 being engaged by locking pins 159*a*, 159*b*, and 159*c*, respectively. It will be noted from FIG. 24 that there is no locking pin for cap 139 covering the ground receptacle. For this reason, as indicated above, the flange 149 of cover 139 can be eliminated. As a result of this arrangement, in the absence of connectors, only cover 139 can be opened and access can be had only to the ground receptacle.

Figure 61:
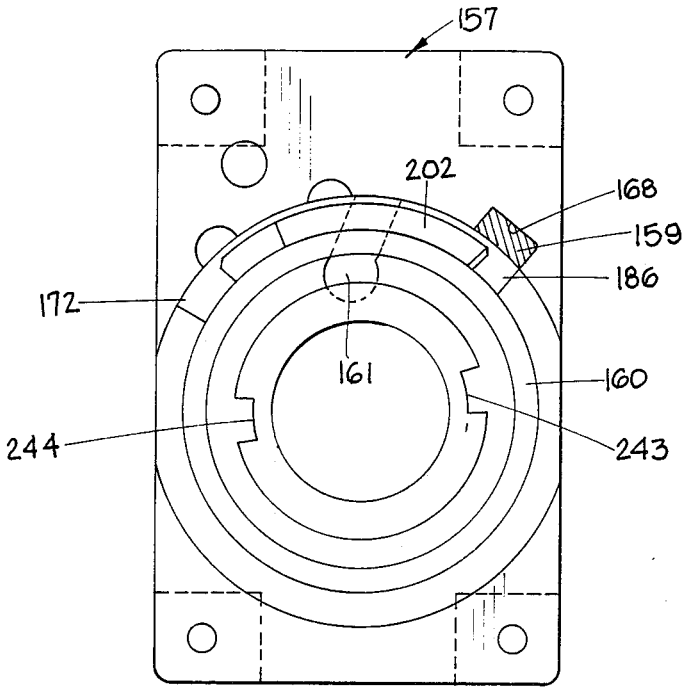
FIGS. 61 and 62 are simplified elevational views showing the maximum counterclockwise rotative position and the maximum clockwise rotative position of the female rotating ring within the receptacle housing, respectively.

Reference is now made to FIG. 61. FIG. 61 is a simplified front elevational view of receptacle housing 157 with the female rotating ring 160 mounted therein. The female rotating ring 160 carries locking latch 161. Locking pin 159 is shown in its rectangular bore 168.

In FIG. 61, the female rotating ring 160 is shown in its maximum counterclockwise rotative position. This is determined by abutment of the female rotating ring lug 202 against receptacle housing stop 172. It will be apparent from FIG. 61 that the maximum clockwise rotative position of female rotating ring 160, in the absence of a connector, will be determined by abutment of locking latch 161 against the side of locking pin 159, since the locking latch normally occupies a position wherein it is out of alignment the locking pin notch 187, as shown in FIG. 33.

Figure 59:
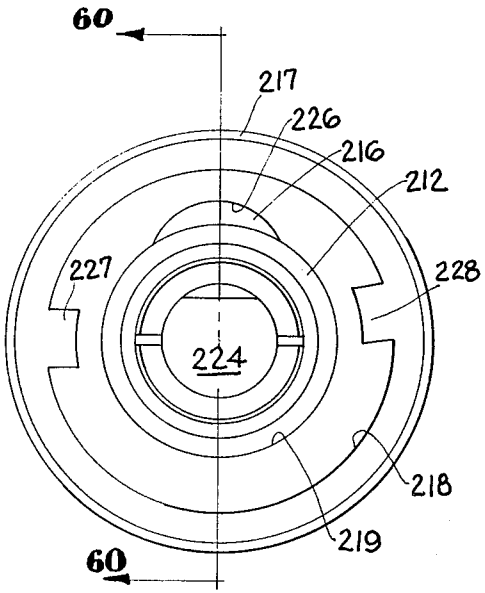
FIG. 59 is a front elevational view of a male connector provided with a polarizing shell and a back ring.

It will be remembered from FIGS. 49 and 59 that the polarizing ring 217 for the male ground connector 212 has a pair of polarizing lugs 227 and 228. It will also be apparent from FIGS. 43 and 61 that the inner annular wall 197 of female rotating ring 160 is provided with a pair of polarizing notches 243 and 244 which correspond to polarizing shell lugs 227 and 228, respectively. Thus, only ground connector 212 having polarizing shell 217 can be inserted in female rotating ring 160 to connect male contact 214 with female contact 175.

Reference is now made to FIGS. 52 through 56. In these figures, there is shown in simplified diagrammatic form the polarizing shell 217 for the ground connector, as well as polarizing shells 217*a* through 217*d* for the neutral connector and the connectors of lines 1, 2 and 3, respectively. It will be understood that polarizing shells 217*a* through 217*d* are identical to polarizing shell 217 with one exception. The polarizing lugs 227*a*–228*a*, 227*b*–228*b*, 227*c*–228*c*, and 227*d*–228*d* of polarizing shells 217*a* through 217*d* differ in their positioning. The female rotating ring in each of the receptacle housings for the neutral connector and the connectors of lines 1, 2 and 3 will be identical to female rotating ring 160 of FIG. 43 except that the polarizing notches in their inner annular walls 197 will be so positioned as to correspond to the polarizing lugs of their respective polarizing shells.

Returning to FIGS. 33 and 60, when the ground connector 212 and its polarizing shell 217 are inserted through panel element opening 97, male contact 214 will be received within the socket of female contact 175. The forward end of connector housing 212 will be received within the confines the inner annular wall 197 of the female rotating ring 160. Finally, the forward end of polarizing shell 217 will be received within the annular groove 196 of the female rotating ring, between its inner and outer annular walls 197 and 198. It will be remembered that the female rotating ring socket 201, containing locking latch 161, intersects the annular groove 196 of the female rotating ring. Therefore, when the connector-polarizing shell assembly 212–217 is fully seated within the female rotating ring 160, the forward portion of polarizing shell 217 will engage locking latch 161 and shift it rearwardly against the action of its compression spring 211 to a position wherein it is aligned with the notch 187 in locking pin 159.

Figure 62:
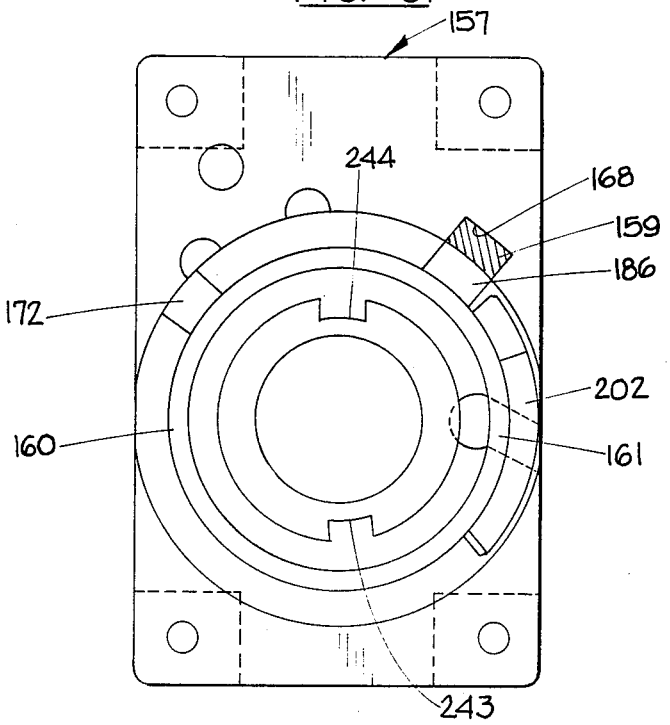

With locking latch 161 no longer precluding further clockwise rotation of female rotating ring 160, the connector-polarizing shell assembly 212–217 and the female rotating ring 160 can be rotated in a clockwise direction to a maximum clockwise position shown in FIG. 62. This clockwise rotation to a maximum clockwise position accomplishes several purposes. First of all, male contact 214 will be locked with respect to female receptacle contact 175 by virtue of engagement of the female receptacle lug 178 in the male contact slot, as taught in the above noted U.S. Pat. RE No. 25,506. The maximum clockwise rotative position of female rotating ring 160 is determined by this engagement between male contact 214 and female contact 175.

It will be noted from FIG. 62 that when the female rotating ring 160 has achieved its maximum clockwise rotative position, its arcuate lug 202 no longer resides in the notch 186 of locking pin 159. As a result of this, locking pin 159 is free to be shoved rearwardly (as viewed in FIG. 33) against the action of its own compression spring 193. This, in turn, means that once the ground connector has been fully mated and locked with its female receptacle, the cover 140 of the neutral receptacle can now be opened. The connector-polarizing shell assemblies and female rotating rings for each of the neutral line and lines 1, 2 and 3 operate in exactly the same manner. Thus, once the neutral line connector has been fully mated and locked with respect to its receptacle, locking pin 159*a* will be released and cover 141 for line 1 can be opened. When the connector for line 1 is fully mated and locked with respect to its receptacle, locking pin 159*b* will be released, enabling cover 142 to be opened. Once the connector for line 2 has been fully mated and locked with respect to its receptacle, cover 143 can be opened for engagement of the connector of line 3 with its respective receptacle. Thus it will be apparent that the connectors for the ground line, the neutral line, and lines 1, 2 and 3 can be connected with their respective receptacles only in that order.

Returning to FIG. 24, once cover 140 has been opened and the connector-polarizing shell assembly of the neutral line has been connected to its respective receptacle, the ground line contact 214 cannot be disconnected from its female contact 175 (see FIGS. 33 and 62). The reason for this is as follows. It will be remembered that once locking pin 159 has been released by connection of the ground line connector to its respective receptacle, locking pin 159 is free to be depressed and is depressed when cover 140 is opened. As will be evident from FIGS. 33 and 62, when locking pin 159 is depressed against the action of its compression spring 193, its notches 186 and 187 are no longer in alignment with female rotating ring arcuate lug 202 and locking latch 161. Thus, as will be evident from FIG. 61, if the locking pin notch 186 is no longer aligned with the female rotating ring arcuate lug 202, counterclockwise rotation of the female rotating ring is precluded by abutment of the arcuate lug 202 against locking pin 159. Without counterclockwise rotation, the male and female contacts 214 and 175 cannot be disconnected and the connector-polarizing shell assembly 212–217 cannot be withdrawn from the opening 97 in panel element 95.

On the other hand, if the neutral line connector is disconnected from its respective receptacle and removed from panel element 95 so that cover 140 will return to its closed position under the influence of its torsion spring (not shown), locking pin 159 will then be free to assume its extended position shown in FIG. 33, under the influence of its compression spring 193. Under these circumstances, the notches 186 and 187 of locking pin 159 will be aligned with respect to female rotating ring arcuate lug 202 and locking latch 161. Therefore, the female rotating ring 160, together with the ground line connector 212 and its polarizing shell 217 can be rotated in a counterclockwise direction to the extent that male and female contacts 214 and 175 are no longer interlocked and the ground line connector 212 can now be removed from panel element 95.

It will be understood from the above description that each of the covers 140 through 143 will cooperate in the same manner with respect to locking pins 159 through 159*c*. As a consequence, the connectors for lines 3, 2, 1, neutral and ground, can only be disconnected from the panel assembly in that order.

Referring to FIGS. 23 and 24, it will be noted that there is no latch pin opening 103 to the right of the right-hand most cover 143. This is true because there is no additional cover for such a latch pin to lock. Nevertheless, the receptacle housing mounted behind cover 143 will be provided with a latch pin. Referring to FIGS. 33 and 40, the latch pin in the right-hand most receptacle housing behind cover 143 will be identical to latch pin 159 with the exception that the nose portion 191 will be removed therefrom. Assuming for the moment that FIG. 33 represents this right-hand most receptacle housing and that panel element perforation 103 in FIG. 33, together with locking pin nose portion 191 have been deleted, it will be apparent that the remainder of the locking pin will always be in the position shown in FIG. 33 under the urging of its compression spring 193. The position of the locking pin will be determined by abutment of the body portion of the locking pin against the inside surface of panel element 95 at the position where a perforation 103 would normally be. Although this right-hand most locking pin has no cover with which to cooperate, its presence is important because it enables locking latch 161 of the right-hand most receptacle housing to function in its normal manner, as described heretofore with respect to FIGS. 61 and 62. The fact that locking latch 161 functions in its normal manner assures that a connector without the proper polarizing shell cannot be used in this right-hand most position of the panel assembly. Thus, the right-hand most position of the panel assembly can only be occupied by the connector of line 3, provided with the proper polarizing shell 217*d* of FIG. 56.

Figure 63:
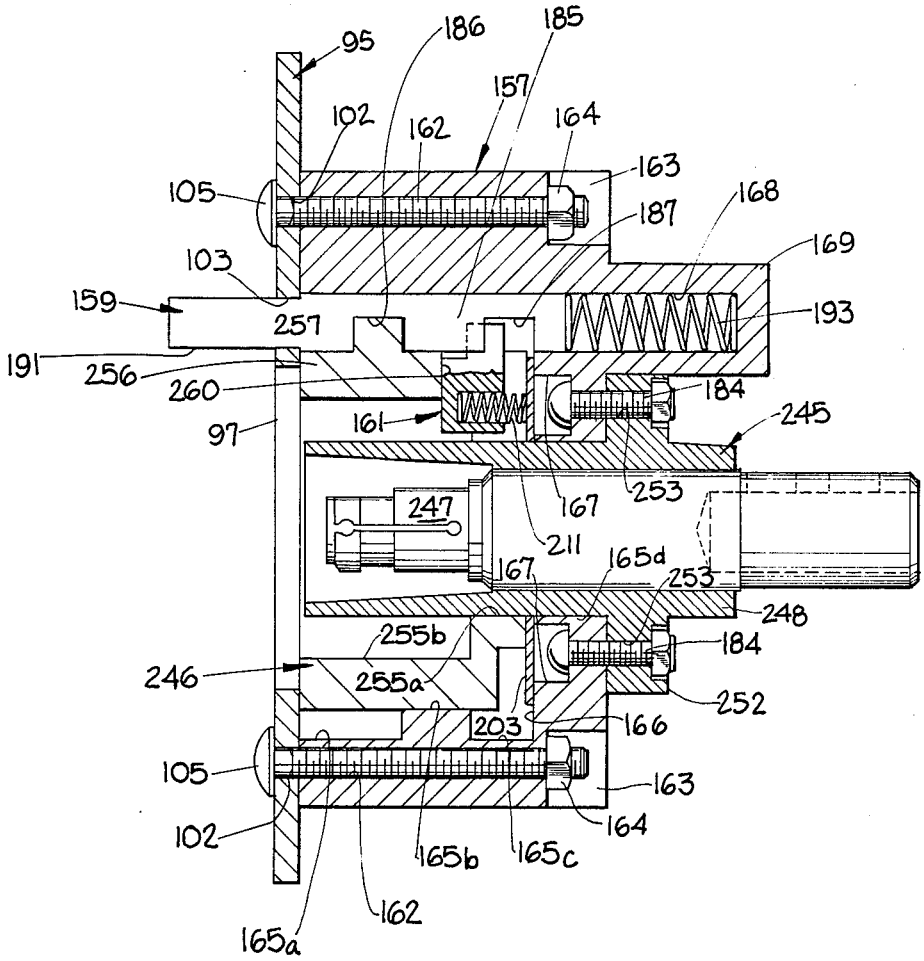
FIG. 63 is a cross sectional view, similar to FIG. 33, illustrating a receptacle housing provided with a male receptacle.

FIG. 63 is a cross sectional view similar to FIG. 33. FIG. 63, however, illustrates an instance wherein the receptacle housing contains a male receptacle, rather than a female receptacle. Again, for purposes of description, the receptacle housing illustrated in FIG. 63 may be considered as being that receptacle housing mounted behind opening 97 in panel element 95 for the ground connector. In FIG. 63, only the male receptacle, generally indicated at 245 and the male rotating ring, generally indicated at 246 differ from the female receptacle 158 and female rotating ring 160 of FIG. 33. The receptacle housing itself, and all of the other parts in association therewith are identical to those shown and described with respect to FIG. 33 and have consequently been given like index numerals.

Figure 64:
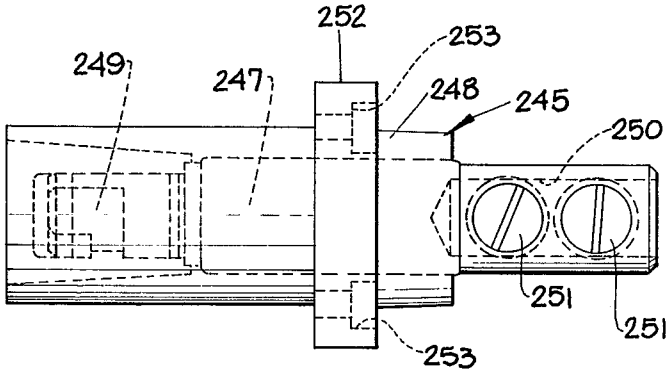
FIG. 64 is an elevational view of a male receptacle.
Figure 65:
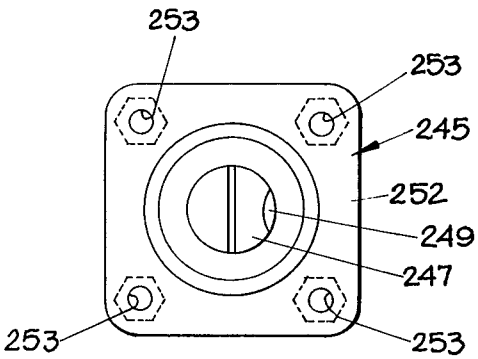
FIG. 65 is a front view of the male receptacle of FIG. 64.

The male receptacle 245 is illustrated in FIGS. 64 and 65. Male receptacle 245 is substantially conventional and comprises a male contact 247 surrounded by an insulative body 248. The male contact may be of the type generally taught in the above mentioned U.S. Pat. RE No. 25,506. The male contact 247 has an L-shaped recess or notch 249 formed therein, adapted to cooperate with an inwardly projecting pin in the socket of the female connector to lock the contacts in mated condition. At its rearward end, the male contact may be connected to a bus bar, a cable or the like. For purposes of an exemplary showing, male contact 247 is illustrated as having a cable receiving socket 250. The cable (not shown) is maintained in the socket 250 by a pair of set screws 251.

Insulative body 248 is provided with a rectangular flange 252, similar to flange 181 of FIGS. 37 and 38, and provided at its corners with perforations 253, identical to perforations 182 of FIGS. 37 and 38.

Figure 66:
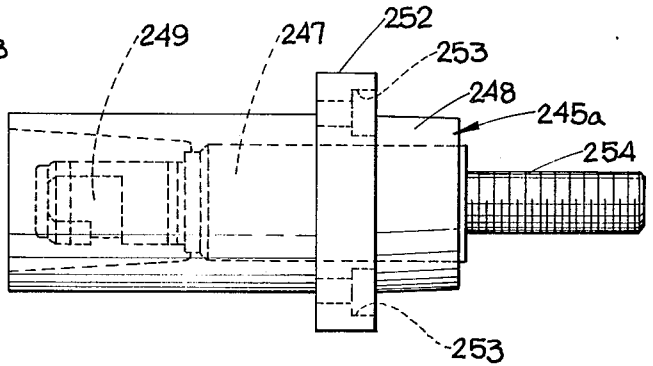
FIG. 66 is an elevational view of another embodiment of male receptacle.

FIG. 66 illustrates a second embodiment of a male receptacle which may be employed in the present invention. The receptacle of FIG. 66 is similar to that of FIGS. 64 and 65, and like parts have been given like index numerals. The receptacle of FIG. 66 differs from that of FIGS. 64 and 65 only in that the rearward end of male contact 247 terminates in a threaded stud 254, as is well known in the art.

As best shown in FIG. 63, the male receptacle 245 is affixed to the receptacle housing 157 by means of the bolts 184 passing through receptacle housing perforations 167 and receptacle flange perforations 253. It will be noted that the forward portion of male receptacle 245 extends through receptacle housing bore portion 165*d* and forwardly through bore portions 165*a*, 165*b*, and 165*c*, nearly to the rear surface of panel element 95.

The male rotating ring 246 of FIG. 63 is illustrated in FIGS. 67 through 70. In many respects, the male rotating ring 246 is identical to the female rotating ring 160. Thus, the male rotating ring comprises a generally cylindrical member having an axial bore. Unlike female rotating ring 160, the axial bore of the male rotating ring 246 is made up of two bore portions 255*a* and 255*b*. The initial or smaller bore portion 255*a* is of the same diameter as the central bore 195 of female rotating ring 160. The second bore portion 255*b* is of larger diameter. Unlike the female rotating ring 160, the male rotating ring 164 has only one annular wall 256. The exterior diameter of annular wall 256 is identical to the exterior diameter of outer wall 198 of female rotating ring 160. The peripheral surface of wall 256 carries an arcuate lug 257, relieved at one end as at 257*a* and 257*b*, and more heavily relieved at the other end as at 257*c* and 257*d*. Lug 257 is identical to lug 202 of female rotating ring 160.

Figure 70:
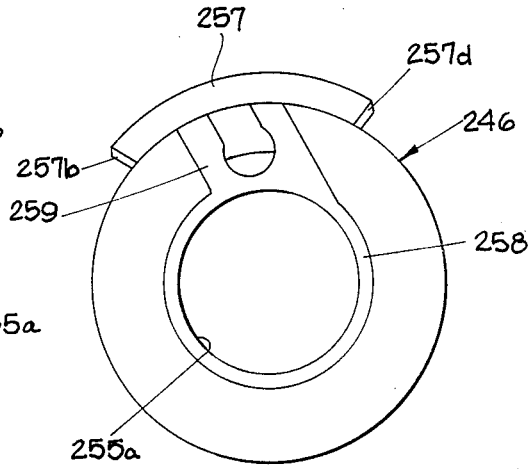
FIG. 70 is a rear elevational view of the male rotating ring of FIG. 67.
Figure 68:
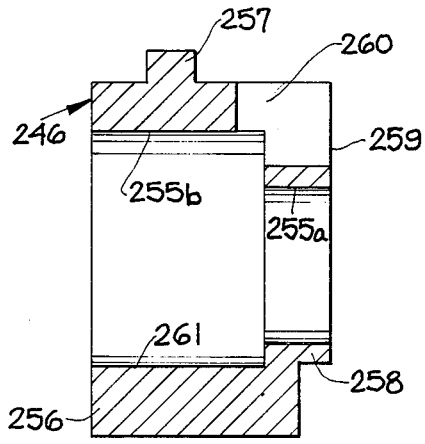
FIG. 68 is a cross sectional view taken along section 68—68 of FIG. 67.
Figure 67:
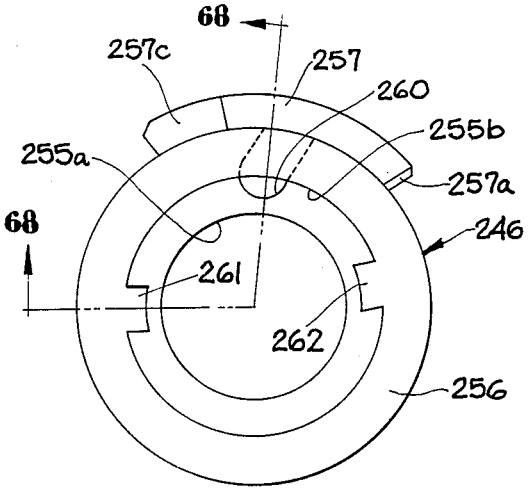
FIG. 67 is a front elevational view of a male rotating ring for use in the housing of FIG. 63.

As is most clearly shown in FIG. 70, the male rotating ring 246 is provided on its rear surface with an annular wall 258 having an extension 259, identical to wall 199 and extension 200 of the female rotating ring (FIG. 46). The male rotating ring 246 is provided with a socket 260, which is essentially identical to the socket 201 of the female rotating ring. Socket 260 differs from socket 201 only in that it intersects bore portion 255*b*, rather than an annular groove, as in the case of the female rotating ring 160. The male rotating ring is completed by the provision of a pair of polarizing lugs 261 and 262 formed on the inside surface of annular wall 256. The purpose of polarizing lugs 261 and 262 will be apparent hereinafter.

FIG. 63 illustrates the male rotating ring 246 mounted in position within receptacle housing 157. The male rotating ring 257 is rotatively mounted on the forward portion of the male receptacle body 248, the forward portion of the male receptacle body 248 extending through bore portion 255*a* and into bore portion 255*b* of the male rotating ring. The forward edge of annular wall 256 of the male rotating ring 246 abuts the rear surface of panel element 95. The annular wall portion 258 of the male rotating ring abuts washer element 203. As a result, the male rotating ring is rotatively and captively maintained within receptacle housing 157. The arcuate lug 257 is receivable within the locking pin notch 186. Locking latch 161 is slidably mounted in male rotating ring socket 260. The male rotating ring is stabilized by receptacle housing bore portion 165*b*, in the same manner as is the female rotating ring in FIG. 33. As is true of the female rotating ring 160, the male rotating ring 246 lends itself well to be molded of an insulative plastic material or the like.

Figure 80:
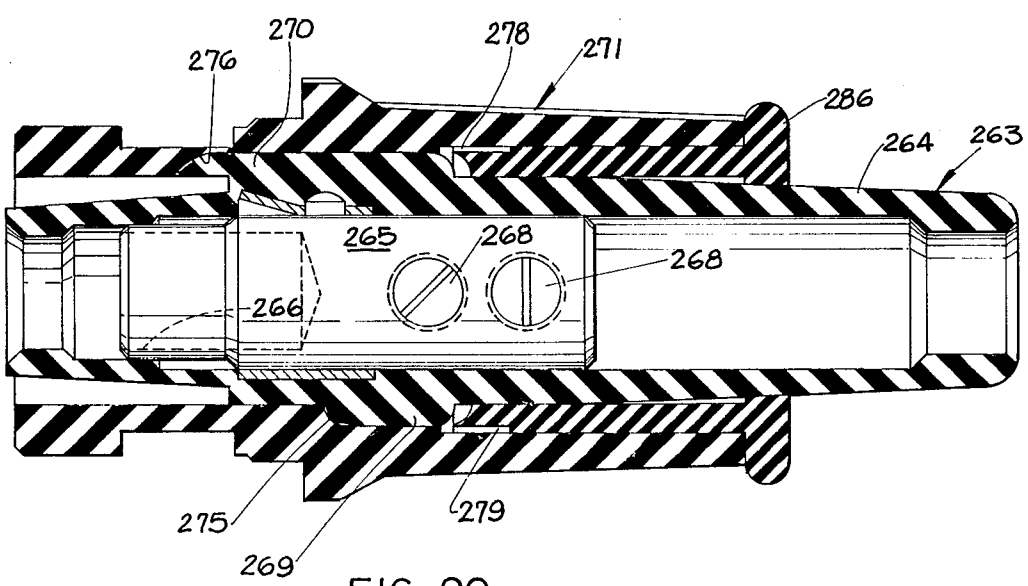
FIG. 80 is a cross sectional view taken along section line 80—80 of FIG. 79.
Figure 79:
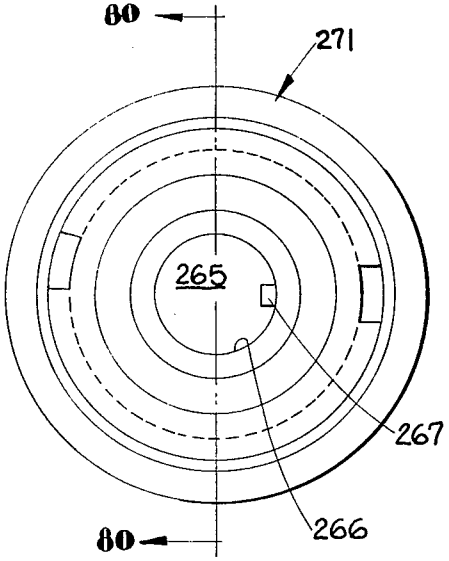
FIG. 79 is a front elevational view of a female connector provided with a polarizing shell and a back ring.

Referring next to FIGS. 79 and 80, a female connector is shown, generally indicated at 263. The female connector comprises an insulative housing 264 and a female contact 265. At its forward end, the female contact has a socket 266 adapted to receive the male receptacle contact. The socket 266 has an inwardly projecting pin 267 formed on its surface. The pin 267 is adapted to cooperate with the L-shaped notch 249 in the male contact to lock the contacts together when mated and rotated one with respect to the other. The rearward end of female contact 265 has an axial bore (not shown) adapted to receive a cable end. The cable end is maintained in this bore by means of a pair of set screws 268.

It will be understood that the female connector 263 is substantially conventional. The exterior of the insulative housing 264 has an annular raised portion 269 similar to the annular raised portion 215 of the connector of FIG. 60, with a forward extension 270, similar to the forward extension 216 of the connector of FIG. 60.

Figure 73:
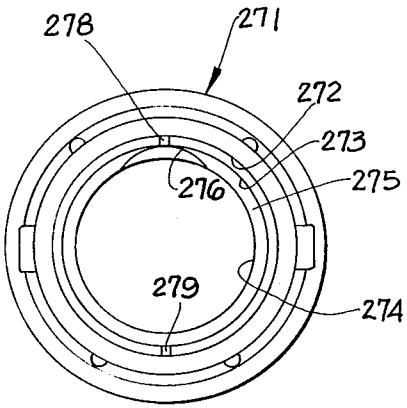
FIG. 73 is a rear elevational view of the polarizing shell of FIGS. 71 and 72.
Figure 72:
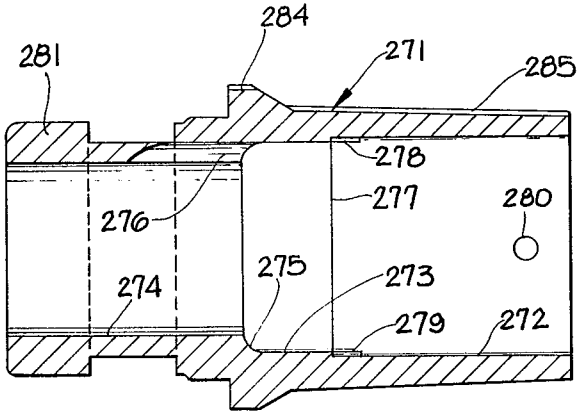
FIG. 72 is a cross sectional view taken along section line 72—72 of FIG. 71.
Figure 71:
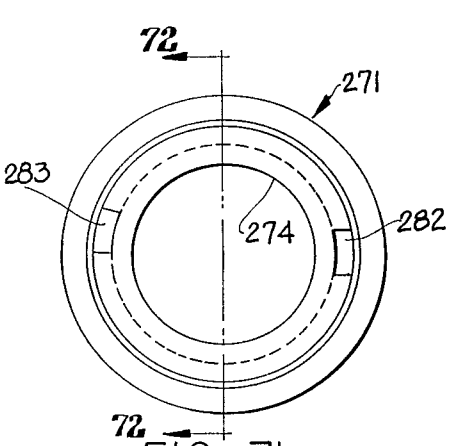
FIG. 71 is a front elevational view of a polarizing shell for a female connector.

Connector 263 is provided with a polarizing shell, generally indicated at 271. Polarizing shell 271 is shown in FIGS. 71 through 73. Polarizing shell 271 comprises a generally cylindrical member having an axial bore. Comparing FIG. 72 to FIG. 50, the rearward portion 272 of the bore is similar in diameter to the portion 222 of polarizing shell 217. The portion 272 is followed by a portion 273 of slightly less diameter, equivalent to bore portion 220 of FIG. 50. Bore portion 273, in turn, is followed by a smaller diameter portion 274, equivalent in diameter to the bore portion 219 of FIG. 50. Unlike FIG. 50, however, the bore portion 274 extends all the way to the forward end of polarizing shell 271.

Between bore portions 273 and 274, an arcuate shoulder 275 is formed, equivalent to shoulder 221 of FIG. 50. A relief 276 is also formed, serving the same purpose as relief 226 of FIG. 50. A narrow shoulder 277 is formed between bore portions 272 and 273. From shoulder 277 a pair of diametrically opposed keys extend rearwardly. The keys 278 and 279 are identical to keys 224 and 225 of FIG. 50, and serve the same purpose. The rearward end of polarizing shell 271 is provided with a diametrically opposed pair of perforations, one of which is shown at 280. Perforation 280 is equivalent to perforation 242, and it and its counterpart (not shown) are adapted to receive screws by which a back ring is affixed to polarizing shell 271 in the same manner as described with respect to FIG. 260.

The forwardmost portion of the front part of polarizing shell 271 is of increased thickness, as at 281. As can most clearly be seen in FIG. 71, the forward portion 281 has a pair of polarizing notches 282 and 283 formed therein, corresponding in position to the polarizing lugs 261 and 262, respectively, of the male rotating ring 246 (see FIG. 67). The remainder of the exterior surface of polarizing shell 271 is similar to that of polarizing shell 217 of FIG. 50, having an enlarged diameter portion 284 and a tapered portion 285 similar to portions 230 and 231, respectively, of polarizing shell 217 of FIG. 50.

Figure 74:
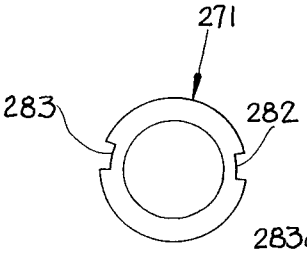

FIG. 74 is a semi-diagrammatic representation of the forward end of polarizing shell 271 with its polarizing notches 282 and 283. Assuming that polarizing shell 271 and its male connector 263 are connected to the ground cable, FIGS. 75 through 78 illustrate exemplary polarizing shells 271*a* through 271*d* for the neutral cable and line cables 1, 2 and 3, respectively. Each of the polarizing shells 271*a* through 271*d* will have their polarizing notches 282*a* through 282*d* and 283*a* through 283*d* in slightly different relative positions. It will be understood that each of the receptacle housings for the neutral cable and the cables for lines 1, 2 and 3 will be provided with male rotating rings having their lugs correspondingly oriented so that each of the cables to be used with the panel assembly can be connected only to its respective receptacle.

As is shown in FIGS. 79 and 80, the polarizing shell 271 is mounted on the insulative housing 264 of connector 263 in exactly the same manner described with respect to the male connector of FIG. 60. To this end, the connector housing 264 is inserted into the polarizing shell 271 from the rear thereof. The enlarged diameter portion 269 of connector housing 264 abuts the arcuate surface 275 of polarizing shell 217. At the same time, the forward extension 270 of connector housing 264 is accommodated by relief 276 formed in the polarizing shell. Polarizing shell 271 is locked in position by back ring 286. The back ring 286 is identical to back ring 233 of FIG. 60, which was described in detail with respect to FIGS. 57 and 58.

It will be understood by one skilled in the art that with the substitution of male receptacle 245 and male rotating ring 246 in receptacle housing 157 and with the provision of a female connector and its appropriate polarizing shell, the operation of the panel assembly of the present invention is otherwise identical to that previously described with respect to FIGS. 23 through 62.

Reference is again made to FIG. 24. It will be understood that in the use of the panel assembly of the present invention, polarity is maintained because the plates 139 through 143 of covers 106 through 110, and their respective connectors are appropriately color coded. Beyond this, however, the polarizing shell of each connector and the rotating ring of its respective receptacle housing are correspondingly keyed to assure that each connector can be mated only with its respective receptacle. By convention, the panel assembly may be provided with male receptacles if it is to serve as an input panel assembly and with female receptacles if it is to serve as an output panel assembly. The panel assemblies of the present invention may be made with two, three, four, or five receptacles, if it is to be used with a two, three, four, or five cable system, respectively. For purposes of an exemplary showing, the panel assembly has been illustrated and described as a five receptacle panel assembly.

Since each of covers 107, 108, 109 and 110 cannot be raised until the correct preceding connector is locked in position, by padlocking cover 106, all of the covers are locked in closed position, when the panel assembly is not in use. If the panel element of FIG. 24 is to be used with a three-cable system, covers 109 and 110 can be padlocked. Similarly, if the panel element of FIG. 24 is to be used with a four-cable system, cover 110 can be padlocked. If the panel element of FIG. 24 is to be used with a two-cable system, it will be necessary to provide means enabling the padlocking of cover 108, in addition to covers 109 and 110. Such means can be the same as described in connection with covers 109 and 110. In the exemplary embodiment, when each of the ground, neutral, line 1, line 2, and line 3 connectors has been inserted into the panel assembly and connected to its respective receptacle, unauthorized removal of any of the cables can be precluded by simply locking the right-hand most connector in its connected position. To this end, a cable-type padlock, similar to those used with bicycles or the like, can be wrapped around the connector and passed through the slot 151 in the cover, thereby locking the connector in place in the panel assembly. It will be understood that the panel assemblies of the present invention provide a simplified system wherein the ground connector mates first and breaks last.

Modifications may be made in the invention without departing from the spirit of it.

What we claim is:

1. An electrical panel assembly for use with cable connectors, said panel assembly comprising a front panel element and at least two receptacles, means to mount said receptacles behind said front panel element arranged in a side-by-side row, said front panel element having an opening therethrough for each receptacle and coaxial therewith through which a cable connector can extend for mating with said receptacle, the receptacle at one end of said row and its front panel element opening comprising the first receptacle and the first front panel element opening respectively, the receptacle at the other end of said row and its front panel element opening comprising the last receptacle and last front panel element opening respectively, locking means provided in association with each front panel element opening except said first front panel element opening, each locking means being shiftable between a normal locking position wherein it prevents entrance of a connector in its respective front panel element opening for connection to its respective receptacle, and an unlocking position permitting entrance of a connector in its respective front panel element opening for connection to its respective receptacle and preventing disconnection of a connector from the preceding receptacle and removal thereof from the preceding front panel element opening, means biasing each of said locking means to its normal locking position, a latch means for each front panel element opening, except the first front panel element opening, each latch means having a latching position latching the locking means for its respective front panel element opening in its normal locking position and an unlatching position releasing its respective locking means, means biasing each latch means to its latching position and being shiftable to its unlatching position by insertion of a connector into the preceding front panel element opening and connection of said last mentioned connector to the receptacle thereof, whereby connectors must be connected to said receptacles in order from said first receptacle to said last receptacle and must be disconnected from said receptacles in order from said last receptacle to said first receptacle.

2. The panel assembly claimed in claim 1 wherein said panel assembly comprises an output panel assembly, said receptacles each comprising a single conductor female receptacle.

3. The panel assembly claimed in claim 1 wherein said panel assembly comprises an input panel assembly, said receptacles each comprising a single conductor male receptacle.

4. The panel assembly claimed in claim 1 including four receptacles and a front panel element opening for each receptacle.

5. The panel assembly claimed in claim 1 including five receptacles and a front panel element opening for each receptacle, said receptacles in order from said first receptacle to said last receptacle comprising a ground receptacle, a neutral receptacle and first, second and third current carrying receptacles.

6. The panel assembly claimed in claim 1 including a cable connector for each of said receptacles, each of said connectors and its respective receptacle having a contact, each of said connectors being insertable into its respective receptacle and rotatable a partial clockwise turn to lock the contacts thereof together, a polarizing shell having a forward portion is mounted on each of said connectors, polarizing means are provided in association with each of said receptacles, said polarizing shells and said polarizing means being so configured that each polarizing shell will cooperate with only one of said polarizing means whereby each connector can be mated only with a predetermined one of said receptacles.

7. The panel assembly claimed in claim 6 including an intermediate panel element and a rear panel element, means to mount said intermediate panel element behind said front panel element and said rear panel element behind said intermediate panel element with said panel elements being in parallel spaced relationship, said receptacles being mounted on said rear panel element, said intermediate panel element having openings formed therein equal in number to and coaxial with said openings in said front panel element and each surrounding the forward end of its respective receptacle, each of said intermediate panel element openings having a non-circular portion and comprising said polarizing means in association with its respective receptacle, each of said locking means comprising an inverted L-shaped member having a short leg and a long leg and being pivotally mounted between said front and intermediate panel elements, spring means engaging said short leg to bias said locking means to its normal locking position, said long leg of said locking means when in its normal locking position partially blocking its respective front panel element opening thereby preventing insertion of a connector in its repsective front panel element opening and mating with its respective receptacle, said locking means being pivotable to said unlocking position wherein said long leg is removed from its respective front panel element opening to a position wherein it engages a slot in said polarizing shell of a connector mated with the preceding receptacle to preclude disconnection thereof, each of said latch means comprising a cylindrical body mounted between said rear and intermediate panel elements, said latch means body having an open forward end communicating with a perforation in said intermediate panel element, a plunger slidably mounted in said latch means body, said plunger having a forward nose portion, said plunger being shiftable between an extended latching position wherein said nose portion extends through said intermediate panel element perforation and blocks said long leg of its respective locking means to preclude shifting of said locking means from said normal locking position to said unlocking position, and a retracted unlatching position wherein said nose portion retracts within said intermediate panel element perforation to free said long leg of said locking means permitting said locking means to be shifted to said unlocking position by a connector inserted into the front panel element opening of that respective locking means, a laterally extending pin affixed to said plunger and passing through a slot in said latch means body, said pin being positioned to be engaged and shoved rearwardly to shift said plunger to said retracted unlatching position by the polarizing shell of a connector when mated with the preceding receptacle thereby freeing its respective locking means and permitting a connector to be inserted into the front panel element opening associated with said locking means and to be mated with the respective receptacle.

8. The panel assembly claimed in claim 7 wherein said panel assembly comprises an output panel assembly, said receptacles each comprising a single conductor female receptacle, said connectors comprising single conductor male connectors.

9. The panel assembly claimed in claim 7 wherein said panel assembly comprises an input panel assembly, said receptacles each comprising a single conductor male receptacle, said connectors comprising single conductor female connectors.

10. The panel assembly claimed in claim 7 including four receptacles and a front panel element opening for each receptacle.

11. The panel assembly claimed in claim 7 including five receptacles and a front panel element opening for each receptacle, said receptacles in order from said first receptacle to said last receptacle comprising a ground receptacle, a neutral receptacle and first, second and third current carrying receptacles.

12. The panel assembly claimed in claim 6 wherein said front panel element has front and rear planar surfaces, a cover for each of said front panel element openings having a hinge portion, a hinge bracket mounted on said front surface of said front panel element adjacent each opening therein, said hinge portion of each cover being pivotally mounted on one of said hinge brackets, each cover being swingable between a closed and an open position, spring means biasing each cover to its closed position, said hinge portion of each cover, except the cover for said first panel element opening, having a laterally extending locking lug, a receptacle housing mounted on the rear surface of said front panel element behind each opening therein, each receptacle housing have a main bore coaxial with its respective front panel element opening, each receptacle being mounted on the rear surface of its respective receptacle housing with its forward end extending into and coaxial with said receptacle housing main bore, said locking means comprising a locking pin slidably mounted in a bore formed in each receptacle housing, said locking pin bore having an axis parallel to the axis of said main bore, said front panel element having a locking pin opening formed therein coaxial with each of said locking pin bores except for the locking pin bore of the receptacle housing for said last receptacle, each locking pin, except a last one in the receptacle housing for said last receptacle, having a forward nose portion, compression spring means in said locking pin bores to urge said locking pins forwardly to said normal locking position wherein each of said nose portions of said locking pins extends through its respective locking pin opening in said front panel element and abuts said locking lug of said cover covering the front panel opening for the next adjacent receptacle in a direction away from said first receptacle, each locking pin nose portion, when its respective locking pin is in its unlocking position, releasing its respective cover locking lug.

13. The panel assembly claimed in claim 12 wherein said polarizing means in association with said receptacles each comprises a ring rotatively mounted on said forward end of its respective receptacle within said main bore of its respective receptacle housing, said ring being coaxial with its respective main bore, the interior of said ring being configured to receive the forward portion of said polarizing shell of its respective connector only, said ring having an arcuate lug extending radially from its peripheral surface and partway thereabout, said latch means comprising a member for each ring slidably received in a peripheral slot in its respective ring, said slot in each ring extending partway across said ring in a direction parallel to the axis of said ring, said latch means being shiftable in said slot in directions parallel to the axis of said ring between a forward latching position and a rearward unlatching position, a portion of said slot in said ring intersecting said ring interior, said locking pin having first and second transverse notches therein, said ring arcuate lug being receivable in said first notch when said locking pin is in its normal locking position, said latch means being receivable in said second notch when said locking pin is in its normal locking position and when said latch means is in its unlatching position, said ring being rotatable between a maximum counterclockwise position determined by a stop formed in said main bore and a maximum clockwise position determined by said locking of said contacts of said connector and receptacle, said arcuate lug of said ring normally being located in said first notch of said locking pin maintaining said locking pin in its normal locking position, said arcuate lug of said ring being removed from said locking pin first notch when said ring is in said maximum clockwise position, said ring being precluded from rotation from said maximum counterclockwise position to said maximim clockwise positions by an abutment of said latch means in its latching position against said locking pin in its normal locking position, said latch means being shiftable to its unlatching position by said forward portion of the polarizing shell when said receptacle is mated with its respective connector and the polarizing shell thereof is received within said ring of said receptacle, whereby when cover for said first receptacle is opened and the proper connector is mated with said first receptacle and said polarizing shell of said last mentioned connector is received within said ring of said first receptacle, said latch means is shifted to said unlatching position in alignment with said second notch of said locking pin by said polarizing shell, permitting said connector, its polarizing shell and said ring to be rotated clockwise to lock said connector and receptacle contacts and to remove said ring aruate lug from said locking pin first notch thereby permitting opening of the cover of the next receptacle for mating with its respective connector, the mating of each receptacle with its respective connector thus unlocking the cover for the next succeeding receptacle until the last receptacle is mated with its respective connector, thereby assuring that the receptacles must be mated with their respective connectors in order from said first receptacle to said last receptacle, and whereby when the connector is disconnected from said last receptacle and the cover therefor is closed, the locking pin of the preceding receptacle housing is shifted to its normal locking position, locking the cover of said last receptacle and permitting counterclockwise rotation of the connector of preceding receptacle and disconnection therefrom such that the disconnection of each connector from its respective receptacle will permit disconnection of the preceding connector from its receptacle until the connector is disconnected from the first receptacle thereby assuring that the connectors must be disconnected from their respective receptacles in order from said last receptacle to said first receptacle.

14. The panel assembly claimed in claim 13 wherein said panel assembly comprises an output panel assembly, said receptacles each comprising a single conductor female receptacle, said connectors comprising single conductor male connectors.

15. The panel assembly claimed in claim 13 wherein said panel assembly comprises an input panel assembly, said receptacles each comprising a single conductor male receptacle, said connectors comprising single conductor female connectors.

16. The panel assembly claimed in claim 13 including four receptacles and a front panel element opening for each receptacle.

17. The panel assembly claimed in claim 13 including five receptacles and a front panel element opening for each receptacle, said receptacles in order from said first receptacle to said last receptacle comprising a ground receptacle, a neutral receptacle and first, second and third current carrying receptacles.

18. The panel assembly claimed in claim 17 including a locking bracket mounted on said front surface of said front panel element adjacent each of said front panel element openings therein for said ground and second and third current carrying receptacles and a cooperating slotted extension on each of said covers for said last mentioned front panel element openings, said locking brackets extending through the slots of their respective cover extensions when said covers are in their closed positions, said locking brackets each having a perforation therein to receive the shackle of a padlock whereby said covers can be locked in closed position by means of padlocks.

* * * * *